US011304507B2

(12) United States Patent
Atherton et al.

(10) Patent No.: US 11,304,507 B2
(45) Date of Patent: Apr. 19, 2022

(54) MODULAR COMPONENT DESK SYSTEM

(71) Applicants: Jacob Atherton, Phoenix, AZ (US); Dennis Shaw, Phoenix, AZ (US)

(72) Inventors: Jacob Atherton, Phoenix, AZ (US); Dennis Shaw, Phoenix, AZ (US)

( * ) Notice: Subject to any disclaimer, the term of this patent is extended or adjusted under 35 U.S.C. 154(b) by 0 days.

(21) Appl. No.: 17/183,844

(22) Filed: Feb. 24, 2021

(65) Prior Publication Data

US 2021/0267360 A1 Sep. 2, 2021

Related U.S. Application Data

(60) Provisional application No. 63/034,626, filed on Jun. 4, 2020, provisional application No. 62/982,208, filed on Feb. 27, 2020.

(51) Int. Cl.

| | |
|---|---|
| ***A47B 3/06*** | (2006.01) |
| ***A47B 13/00*** | (2006.01) |
| ***A47B 21/04*** | (2006.01) |

(52) U.S. Cl.

CPC ..... *A47B 3/06* (2013.01); *A47B 13/003* (2013.01); *A47B 21/04* (2013.01); *A47B 2200/0089* (2013.01); *A47B 2230/07* (2013.01)

(58) Field of Classification Search

CPC ..... A47B 3/06; A47B 13/003; A47B 21/04; A47B 2200/0089; A47B 2230/70; A47B 2013/006; A47B 2013/02; A47B 47/03

USPC ..... 108/157.1, 50.01, 50.02; 312/194, 195, 312/223.3, 107, 108

See application file for complete search history.

(56) References Cited

U.S. PATENT DOCUMENTS

| | | | | |
|---|---|---|---|---|
| 3,125,387 A * | 3/1964 | Abrahamson | A47B 47/03 312/195 |
| 3,586,409 A * | 6/1971 | Cisler | F16B 12/00 312/111 |
| 4,176,889 A * | 12/1979 | Gartung | A47B 17/00 108/26 |
| 4,600,248 A * | 7/1986 | Pflieger | A47B 17/00 312/195 |
| 5,486,042 A * | 1/1996 | Heisler | A47B 17/006 312/196 |

(Continued)

FOREIGN PATENT DOCUMENTS

| | | |
|---|---|---|
| DE | 202019105602 | * 12/2019 |
| FR | 1476786 | * 4/1967 |

(Continued)

*Primary Examiner* — Janet M Wilkens

(74) *Attorney, Agent, or Firm* — Lewis Roca Rothgerber Christie LLP

(57) ABSTRACT

Disclosed is a modular component desk which is customizable and capable of being modified by individual end users. The desk may include a modular attachment frame with a plurality of threaded holes and magnets spaced apart as to allow for the attachment of various components of the desk at various locations on the frame. The desk may include different desk components to be used in the construction of a custom desk including drawers of various size, storage compartments of various size, various leg supports, and various desktop finishing surfaces which may removably attach to the fame using magnets. There may also be attachment frames and desktop surfaces of varying size, which can optionally be linked together to build desks of T and L shapes, among many numerous possibilities.

11 Claims, 25 Drawing Sheets

(56) References Cited

U.S. PATENT DOCUMENTS

| | | | | | |
|---|---|---|---|---|---|
| 5,983,420 | A * | 11/1999 | Tilley | A47B 13/02 | 108/91 |
| 6,109,707 | A * | 8/2000 | Ozaki | G11B 33/0438 | 312/111 |
| 2001/0030849 | A1* | 10/2001 | Garnica | A47B 96/06 | 361/679.02 |
| 2005/0204646 | A1* | 9/2005 | Tupper | E05B 65/462 | 52/36.5 |
| 2007/0057605 | A1* | 3/2007 | Wien | A47B 13/003 | 312/195 |
| 2012/0079968 | A1* | 4/2012 | von Bereghy | A47B 13/02 | 109/1 S |
| 2012/0187814 | A1* | 7/2012 | Fryling | A47B 47/03 | 312/265.1 |

FOREIGN PATENT DOCUMENTS

| | | | |
|---|---|---|---|
| GB | 1571587 | * | 7/1980 |
| KR | 20110057290 | * | 6/2011 |
| WO | 2011059389 | * | 5/2011 |
| WO | 2011065736 | * | 6/2011 |
| WO | 2019204868 | * | 10/2019 |

* cited by examiner

MODULAR COMPONENT DESK SYSTEM

CROSS-REFERENCE TO RELATED APPLICATION(S)

This application claims the priority to and the benefit of U.S. Provisional Patent Application Ser. No. 62/982,208, filed on Feb. 27, 2020 and U.S. Provisional Patent Application Ser. No. 63/034,626, filed on Jun. 4, 2020, the contents of which are both incorporated herein by reference in their entirety.

BACKGROUND

1. Field

Aspects of example embodiments of the present disclosure relate to a modular component desk system.

2. Related Art

Desks are a fixture of offices and homes across the world. Typically, desks are single-configuration. For example, a desk may have a table top and one or more legs that are designed to be fitted together in only one way. In some cases, a desk may include cabinetry, such as drawers, but most often such cabinetry is designed to be placed at a single location under or on the table top.

With this in mind, desks are often purchased to fit a particular need at the time and to fit certain size constraints, available footprint, storage needs or desires, etc. Such single-configuration desks cannot be, within reason, reconfigured. As such, they often remain in the same spot and in the same configuration for their entire lifespan. Large organizations may need to source desks from a number of different manufacturers, or at least a number of different desk models from the same manufacturer, to fill an office space. And employees are generally "stuck" with a particular desk configuration until replacement. Similarly, individuals with home offices often face changing circumstances that force them to move their desk to another location, such as a new child or long-term guest, but the user may not have another space suitable for a large, fixed configuration desk. Further, manufacturers must be able to manufacture a number of configuration-specific parts, increasing the cost of the desk.

SUMMARY

According to embodiments of the present disclosure, a modular component desk is provided that is individually configurable to have various different configurations according to the available footprint, desired price, customer desires, etc. According to one embodiment, the modular component desk includes an attachment frame (also referred to as the Modular Attachment Point or M. A. P.), a leg assembly attached to the attachment frame, and a table top attached to the attachment frame. In some embodiments, the modular component desk may include a plurality of leg assemblies. In some embodiments, storage compartments (e.g., cubbies), drawer sets, storage boxes, etc. may be added to the desk by being connected to the attachment frame. In other embodiments, however, the attachment frame and table top may be integrally formed and/or permanently attached to each other.

The attachment frame may be a panel having a plurality of openings (e.g., through-holes) arranged in a two-directional matrix. In some embodiments, the openings may be equally spaced in both directions, or separately but equally spaced in each of the two directions (e.g., 3 inches between openings in a first direction but 4 inches between openings in a second direction, etc.). Various component assemblies, such as the leg assembly, table top, drawer sets, etc. may each include an attachment plate having one or more openings (e.g., through-holes) corresponding to openings in the attachment frame. Each attachment plate may include a plurality of openings to provide sufficient mechanical connection and rotational location of the component assembly relative to the attachment frame, but in some instances an attachment plate may only have one opening (such as for a small circular component assembly for which rotational positioning is irrelevant). The openings in the attachment plate may have the same arrangement and spacing as the openings in the attachment frame or be spaced apart from each other at a multiple of the spacing in the attachment frame. Thus, the various component assemblies may be easily connected to the attachment frame by a nut and bolt connection or other suitable mechanical configuration, such as a push pin, rivet, self-tapping screw, etc.

Embodiments of the present disclosure may also include an attachment frame with a plurality of magnets in the frame and a desktop surface with a plurality of corresponding magnets in the desktop. The magnets allow the desktop surface to be removably installed on the frame quickly and easily in a level orientation.

Some embodiments may include: a modular attachment core with a plurality of magnets in an upper surface of the modular attachment core; a desktop with a plurality of magnets in a lower surface of the desktop, the desktop magnets being arranged to be attached to the corresponding magnets in the modular attachment core; a storage compartment with a plurality of threaded holes and an attachment bracket having a plurality of through-holes which correspond to the threaded holes in the modular attachment core; a plurality of vertical supports configured to attach to the modular attachment core, wherein the supports and the storage compartment are configured to be attached to the modular attachment core at different points.

Other embodiments may be a desk configured to be modified by an end user having: a central connecting structure with a plurality of threaded holes in the structure; an upper finishing surface configured to attach to the upper surface of the central connecting structure; a storage compartment configured to attach to a lower surface of the central connecting structure; a plurality of vertically orientated supports which the central connecting structure is secured to and; a bracket which is configured to attach the storage compartment and the vertically orientated supports to the central connecting structure.

Yet additional embodiments may be a modular desk including: a horizontally orientated frame having a plurality of screw holes spaced apart through the frame; a flat upper surface configured to attach to the frame; a plurality of legs configured to attach to the frame; and a plurality of storage compartments configured to attach to the frame, wherein the legs, and storage compartments are configured to be attached to the frame in various orientations.

This summary is provided to introduce a selection of features and concepts of example embodiments of the present disclosure that are further described below in the detailed description. This summary is not intended to identify key or essential features of the disclosure nor is it intended to be used in limiting the scope of the disclosure. One or more of the described features according to one or more example embodiments may be combined with one or more other described features according to one or more example embodiments to provide a workable method or device.

DETAILED DESCRIPTION

The detailed description set forth below in connection with the appended drawings is intended as a description of example embodiments of the present disclosure and is not intended to represent the only forms in which the present disclosure may be embodied. The description sets forth aspects and features of the present disclosure in connection with the illustrated embodiments. It is to be understood, however, that the same or equivalent aspects and features may be accomplished by different embodiments, and such other embodiments are encompassed within the spirit and scope of the present disclosure. Further, descriptions of features, configurations, and/or other aspects within each embodiment should typically be considered as available for other similar features, configurations, and/or aspects in other embodiments.

Figure 1A:
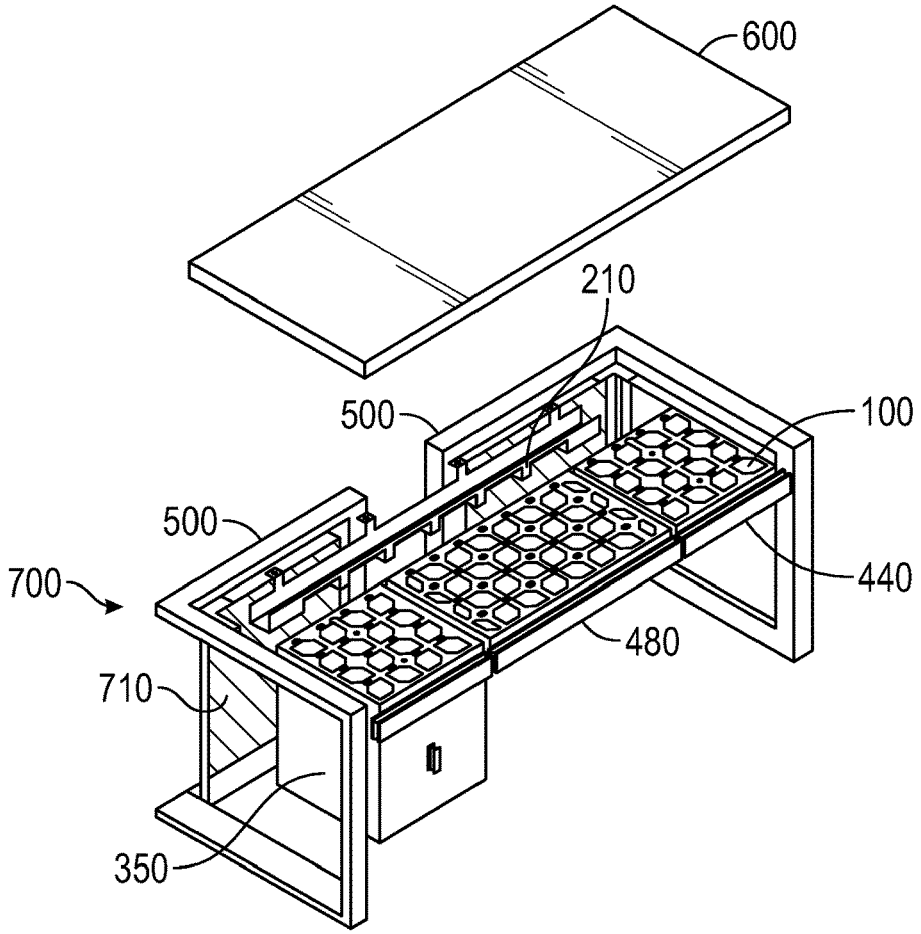
FIGS. 1A-1C show an example configuration modular component desk according to embodiments of the present disclosure.
Figure 1B:
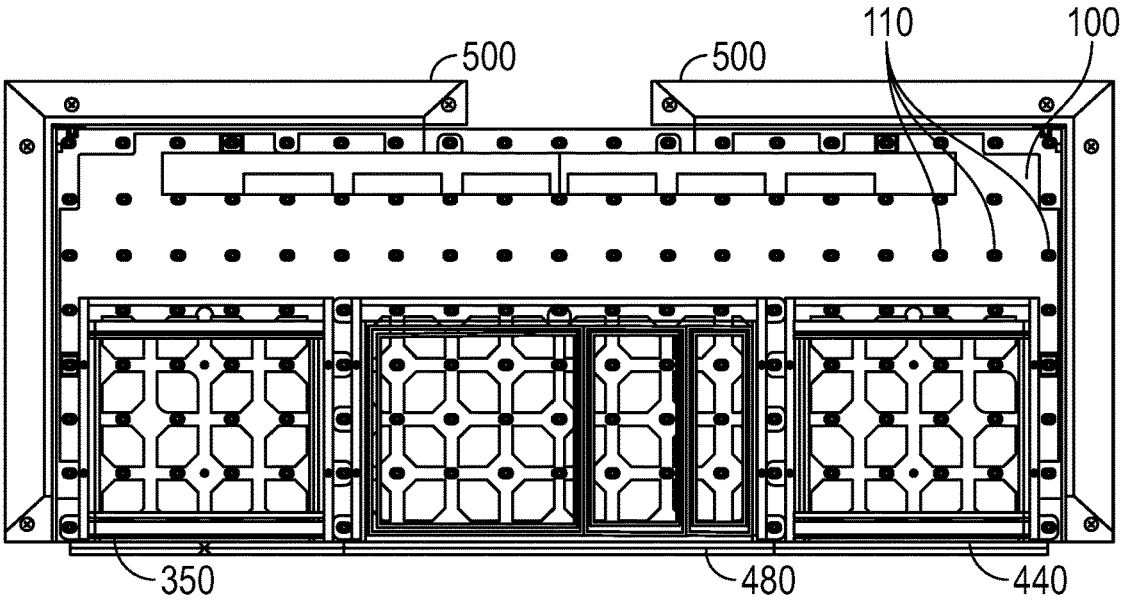
Figure 1C:
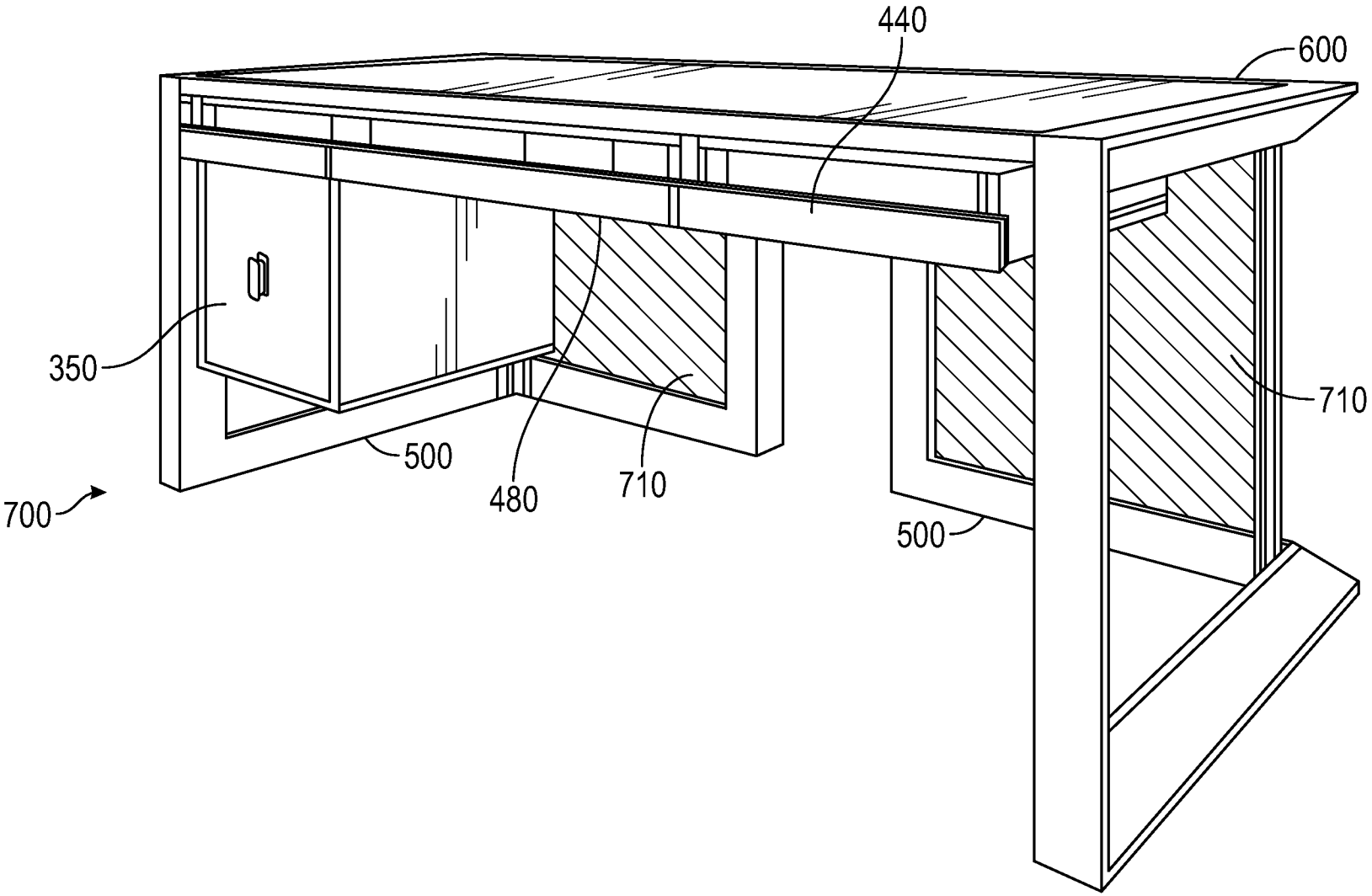

Referring to FIGS. 1A-1C, an example configuration of a modular component desk 700 according to an embodiment is illustrated. FIG. 1A shows an exploded view of the desk assembly, and shows a modular attachment point (herein "M. A. P." or "attachment frame") 100 below a desktop surface 600. FIG. 1B shows a cross sectional view of the modular component desk 700. FIG. 1C shows a perspective view of the modular component desk 700 in an assembled state.

Referring again to FIG. 1A, as one example configuration, a standard drawer 450, a wide drawer 480, and a relatively large storage compartment 350 are attached to the M. A. P. 100 below the desktop surface 600. The modular component desk 700 includes, as a non-limiting example, two equilateral L shaped legs 500 that support the M. A. P. 100 and the desktop surface 600, which is attached to the M. A. P. 100. The modular component desk 700 may further include a cable tray 210 behind the drawers 480/440 and storage compartment 350. The cable tray 210 may accommodate various electrical connections (e.g., cords, cables, etc.) that connect electronic devices on the desktop surface 600 to electrical outlets and/or other components, such as a computer tower. The modular component desk 700 may also include modesty panels 710, which are at a front of the modular component desk 700, attached to the M. A. P. 100, and may extend between the legs 500 between the cross members 508 to hide the under-desk space from view the front or sides of the desk.

Figure 2A:
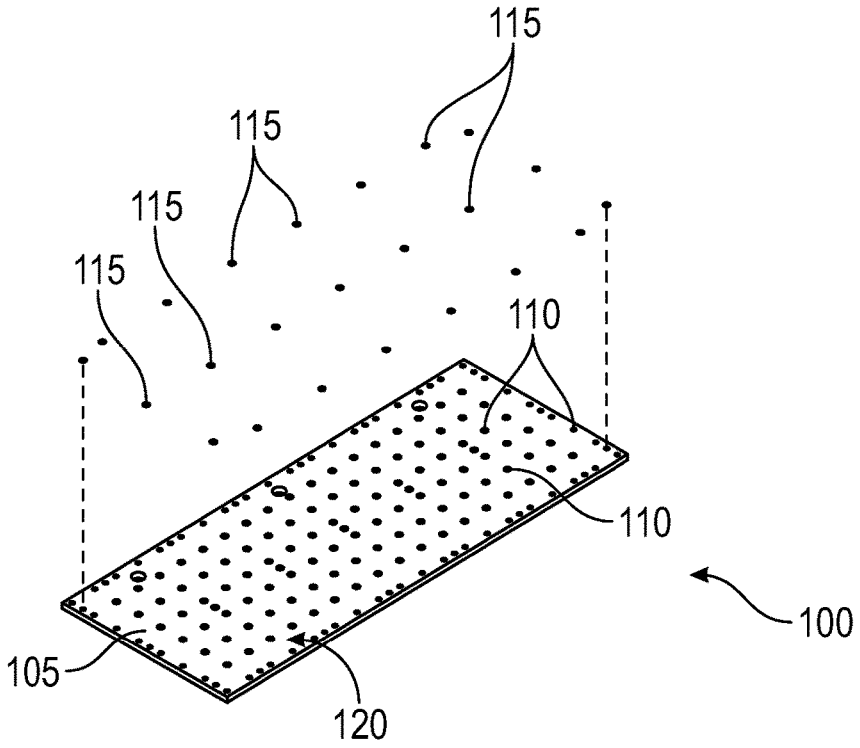
FIGS. 2A-2F show modular attachment points according to embodiments of the present disclosure.
Figure 2B:
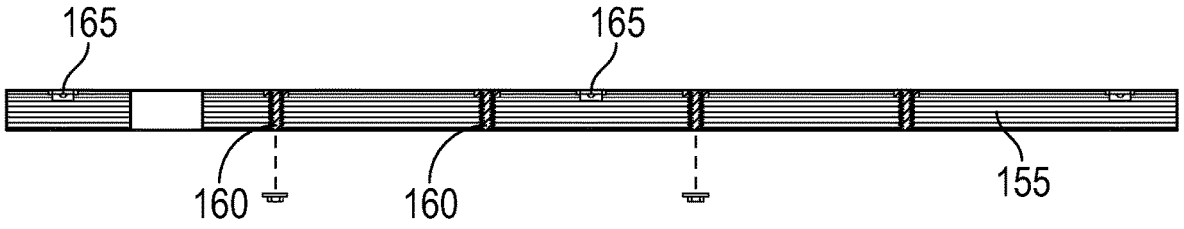
Figure 2C:
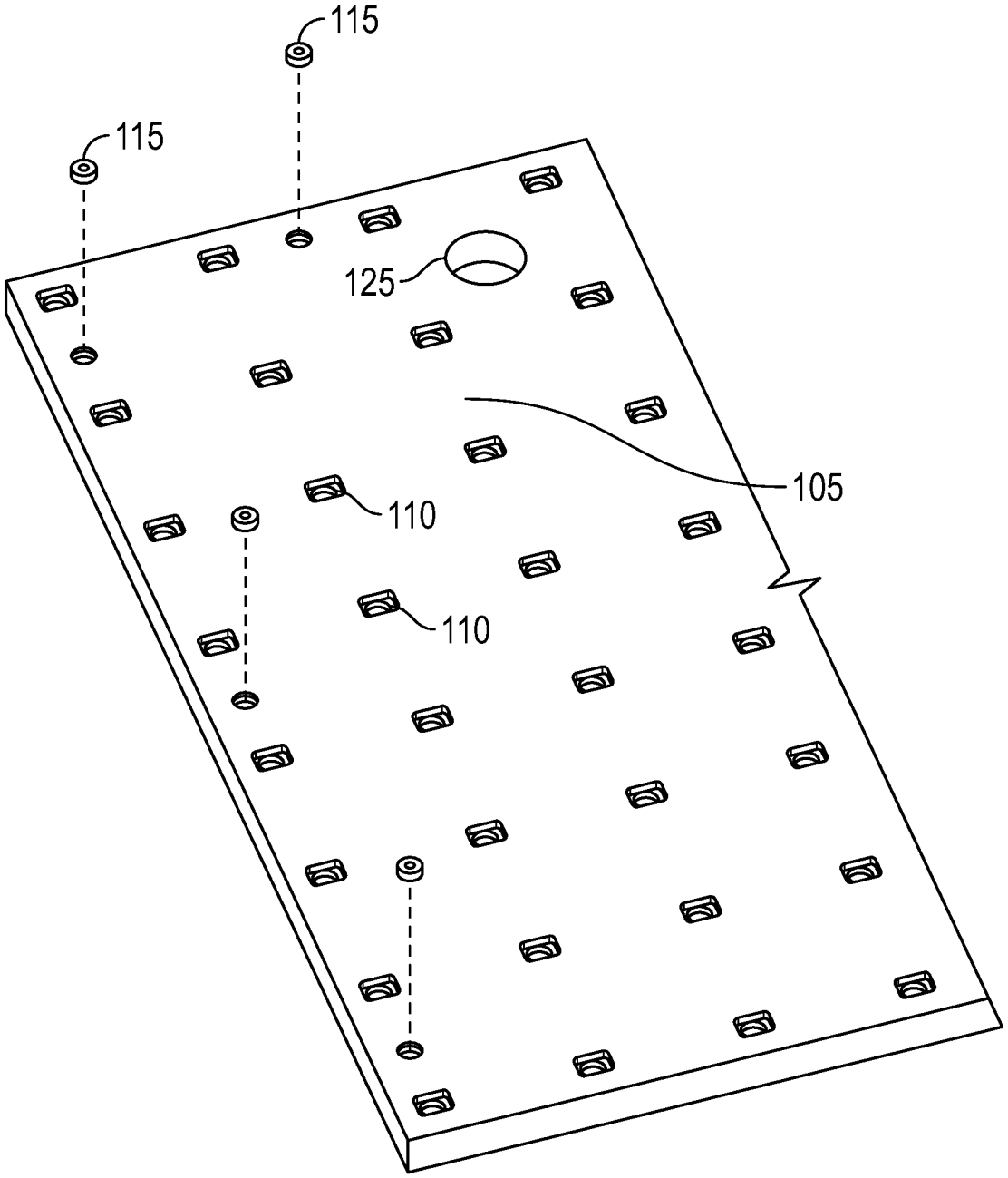
Figure 2D:
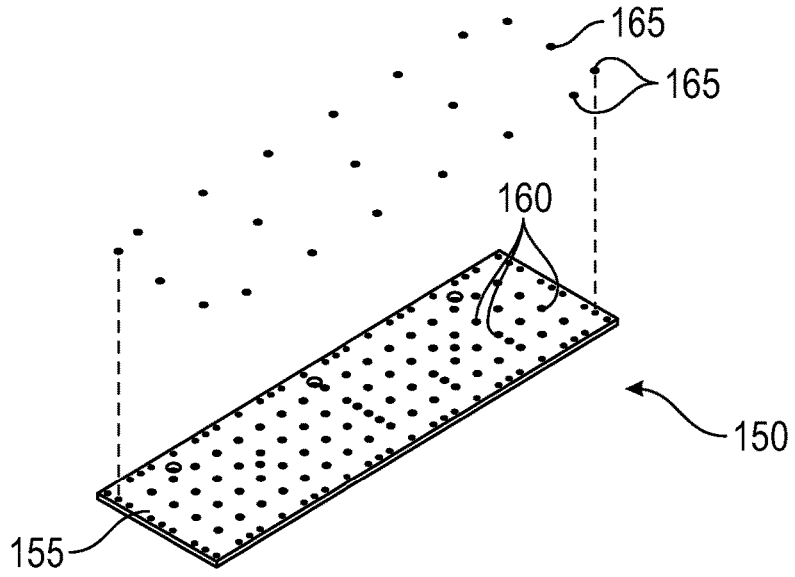
Figure 2E:
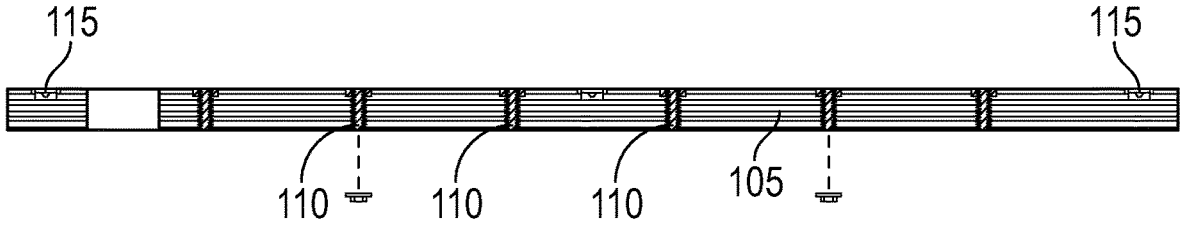
Figure 2F:
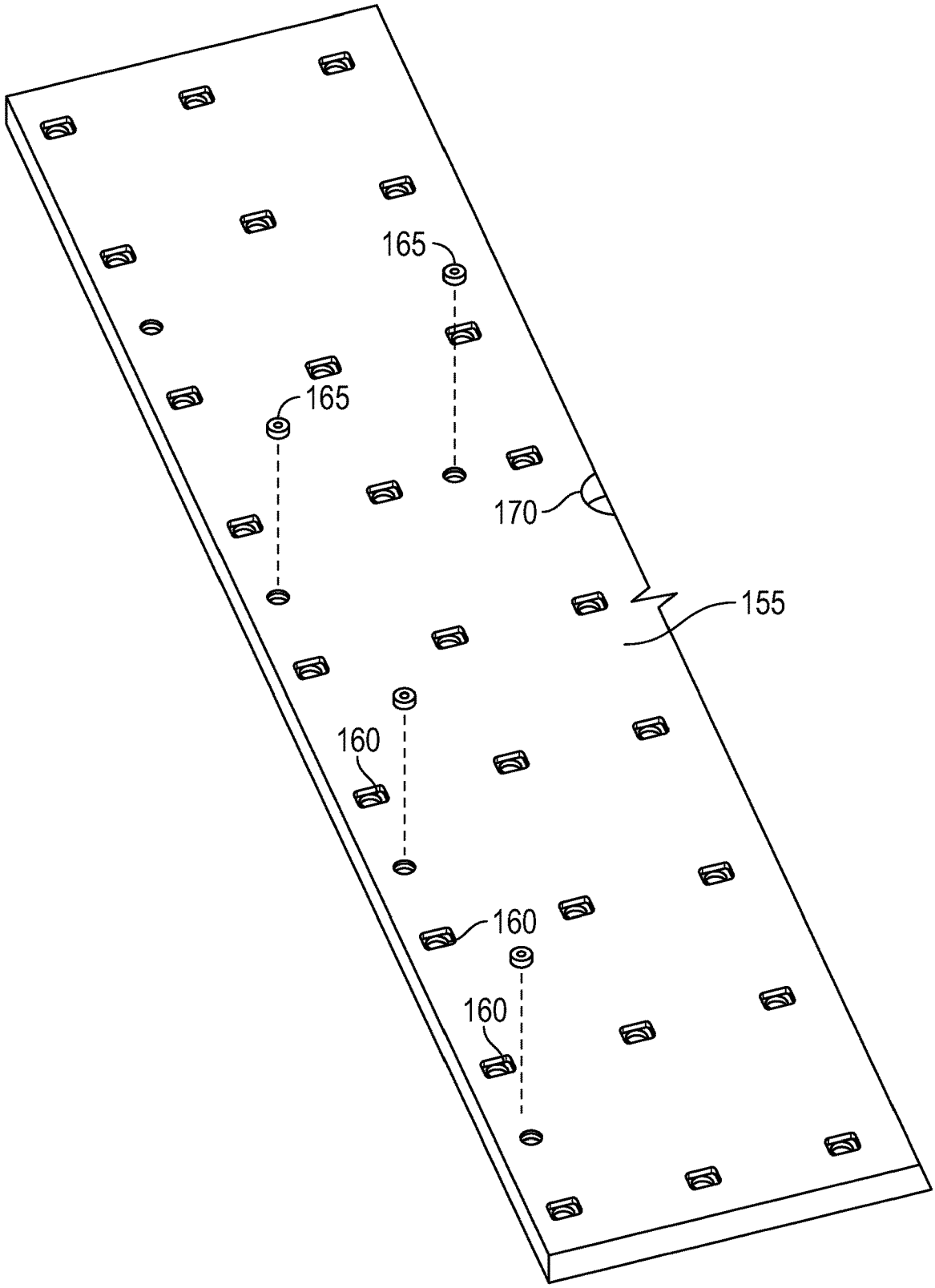

Referring to FIGS. 2A-2F, modular attachment points according to embodiments are illustrated. FIG. 2A shows an exploded perspective view of the M. A. P. 100. The modular desk according to the present embodiment may utilize the M. A. P. 100 as a central attachment frame to which various components of the may be removably attached at various areas of (e.g., points on) the frame.

The modular attachment point 100 may have a body 105 with a plurality of openings (e.g., holes, through-holes, etc.) therein. In one embodiment the openings are open to a lower surface of the modular attachment point 100. In another embodiment, the openings are open to an upper surface. The openings may be threaded holes 110 which are tapped to accommodate the insertion of bolts into the openings. In some embodiments, threaded inserts may be inserted into (e.g., press fit into or glued into, etc.) the openings. For example, when the body 105 is made of wood or the like, metal sleeves may be more robust for repeated installation of components than the wood. The openings may be arranged in a two-dimensional matrix along the body 105. For example, the openings may be arranged adjacent each other in the first and second directions in a grid pattern. The various components of the desk may use bolts which screw into the threaded holes 110 to attach to the modular attachment point 100.

The threaded holes 110 may be equally spaced from each other. In one embodiment, the threaded holes 110 may be spaced one, two, or three inches apart from each other in both the first and second directions. In other embodiments, however, the threaded holes 110 may be spaced apart by a first distance in the first direction and spaced apart by a second distance in the second direction, with the first and second distances being different from each other. By providing different spacing in the first and second directions, errors in connecting the component assemblies to the modular attachment point 100 may be reduced or avoided as a component assembly's openings (described in more detail below) would only match in two directions, instead of four directions when the openings are equally spaced in both directions.

There may be a plurality of magnets 115 arranged within slots (or grooves) 125 in an upper surface 120 of the modular attachment point 100. The magnets 115 may be inserted into a second plurality of openings in an upper surface 120 of the modular attachment point 100. The magnets 115 may be glued in the holes, tightly inserted into holes drilled to a corresponding size to form a friction fit, attached using adhesive tape, possibly double-sided adhesive tape, or attached using any other suitable means known within the art. The plurality of magnets 115 may correspond to a plurality of magnets placed within a lower surface of a desktop surface, such as those shown in FIGS. 6A-6D, and may be configured to allow for the magnetic attachment of a desktop surface to the modular attachment point 100. The plurality of magnets 115 may be ½×3/16 inch neodymium rare earth magnets, grade N52, countersunk ring magnets, with a pull force of about 9.65 lbs; ½×⅛ inch neodymium rare earth magnets, grade N52, disc magnets with a pull force of about 8.15 lbs; or other similar magnets of sufficient strength to attach the desktop surface to the M. A. P. 100.

The modular attachment point 100 may include (or may be formed of) engineered wood, plywood, solid wood, metal, rigid plastic, or any other suitable material. The modular attachment point 100 may have one or more through-holes 125 as to provide access to a desktop surface atop the modular attachment point 100. The through-hole(s) 125 may also serve as a grommet hole for wire management which allows electrical cords to pass through the M. A. P. 100, and keep them in place.

A modular attachment point 150 according to another embodiment may have a different size that the M. A. P. 100 as to allow for the construction of desk systems of different sizes and shapes. The modular attachment points 150 may include a core 155, a plurality of threaded holes 160 in (or open to) a lower surface of the core 155, spaced apart from each other in a manner described above, a plurality of magnets 165 in an upper surface 120 of the core 155, and a through-hole 170.

In other embodiments, the modular attachment point has a corrugated profile. The corrugations may be arranged adjacent each other in a first direction (e.g., a short direction) of the modular attachment point and may extend in a second direction (e.g., a long direction) of the modular attachment point to provide increased strength in the second direction. However, the present disclosure is not limited thereto.

The modular attachment point may include (or may be made of) metal and may be stamped to have the corrugated profile. In other embodiments, such as for smaller desks, the attachment plate may include (or be made of) a rigid plastic and may be molded to have the corrugated profile.

The modular attachment point may have a plurality of openings therein. The openings may be formed therein by, for example, punching during a stamping operation or machining, such as drilling. In the case of a plastic modular attachment point, the openings may be formed therein during the molding or drilled or punch after the molding.

The openings may be arranged in a two-dimensional matrix along the modular attachment point. For example, the openings may be arranged adjacent each other in the first and second directions in a grid pattern. In some embodiments, the openings may be only in the depressed areas (e.g., the lower portions) of the corrugated modular attachment point, only in the raised areas (e.g., the upper portions) of the corrugated modular attachment point, or in both the depressed and raised areas. In some embodiments, the openings in the raised portions of the modular attachment point may be for connecting component assemblies to an upper surface of the modular attachment point, and the openings in the lower portions of the modular attachment point may be for connecting component assemblies to a lower surface of the modular attachment point. The opening may be spaced apart from each other in the same manner as the threaded holes described above.

Referring to FIGS. 6A-6D, the modular component desk may include a desktop (e.g., a tabletop) 600. The desktop 600 may include (or may be formed of) metal, wood, engineered wood, veneer wood, laminate, plastic, stainless steel, composite materials with different layers of the above materials, and/or any other suitable material or combination thereof. The desktop 600 may have a smooth upper surface 605 formed from one of the above listed materials, or alternatively may have a glass surface as the uppermost layer of the desktop surface 600. There may be a plurality of magnets 610 within recesses 620 in the lower surface 615 of the desktop 600, the position of which correspond to the magnets in the modular attachment point, allowing the desktop surface to be magnetically fastened to the modular attachment point. Using magnets to fasten the desktop 600 to the modular attachment point may allow for the desktop 600 to be removed, replaced, and positioned at different locations along the M. A. P. 100, while also attaching the desktop 600 onto the M. A. P. 100 in a level (flat) orientation, which is not slanted, in order to be comfortable for the user. It also allows for the easy interchangeability and customization of various desktop surfaces (e.g. stainless steel, glass, wood, etc.). The plurality of magnets 610 may be ½×3/16 inch neodymium rare earth magnets, grade N52, countersunk ring magnets, with a pull force of about 9.65 lbs; ½×⅛ inch neodymium rare earth magnets, grade N52, disc magnets with a pull force of about 8.15 lbs; or other similar magnets of sufficient strength to attach the desktop surface to the M. A. P. 100.

Thus, in such embodiments, the separate modular attachment point may be omitted and the component assemblies attached to (e.g., attached directly to) the integral table top and modular attachment point via the threaded inserts, and magnets in the modular attachment point and table top.

In some embodiments, the table top may be mechanically fastened to a secondary material, such as wood, composite wood, solid surface (e.g., an artificial marble material, such as Corian®, a registered trademark of DuPont de Nemours, Inc., or Hi-Macs®, a registered trademark of LG Chem, Ltd.), etc., to create a hybrid table top assembly. The table top may have a smoother finish than the attachment frame to be suitable as a table top. The table top may include separate pieces or only a single piece attached to the upper and side surfaces of the attachment frame to ensure a pleasing aesthetic appearance and durable working surface. In some embodiments, the table top may include (or may be primarily formed of) wood, solid surface, paper resin, or plastic.

The table top may be used in combination with various component assemblies to create customizable solutions for desks, credenzas, and various table uses, as discussed below.

Referring to FIGS. 3A-5L, the component assemblies may include one or more of static or kinetic (e.g., adjustable) leg assemblies, cubbies, drawer sets, storage compartments and bins, modesty panels, accent panels, privacy partitions, etc. To provide modularity, the component assemblies have a universal attachment plate for connecting (e.g., for mechanically fastening) the component assembly to the attachment frame.

The attachment plates have one or more openings therein which correspond to the openings in the attachment frame. For example, the openings in the attachment plates may be spaced apart at multiples of the opening spacing of the openings in the attachment frame. Because it may not be necessary to utilize all of the openings in the attachment frame for attaching the component assembly, some of the openings in the attachment frame may be overlapped by the component assembly but may not be used to attach the component assembly to the attachment frame (see, e.g., FIGS. 5B, 5D, 5H, 5I, 5K, and 5L which show how the various attachment plates are aligned under the M. A. P.). Thus, as one example, when the openings in the M.A.P are spaced apart from each other by three inches, the openings in the M.A.P may be spaced apart from each other by three inches, six inches, nine inches, etc. to correspond with openings in the M. A. P.

The attachment plates may correspond to ones of the component assemblies, or may be common to a number of the component assemblies. For example, the attachment plates may be specific to ones of the component assemblies and may be integrally formed therewith or attached thereto by, for example, mechanical fastener(s), including but not limited to bolts, nuts screws, snap fittings, friction fittings, etc. In this case, the attachment plate may have a shape that corresponds with a shape of the corresponding component assembly to avoid unnecessarily covering any portions of the attachment frame not used to attach the component assembly thereto.

In another embodiment, a number of standard attachment plates may be pre-formed in various sizes, such as small, medium, and large. These may have a rectangular shape or any other suitable shape and openings therein arranged at intervals corresponding to the intervals in the attachment frame. The component assemblies may similarly have openings (e.g., blind holes, etc.) arranged at the same interval as in the attachment frame. In this way, a standard attachment plate may first be attached to the component assembly, with the size of the attachment plate selected to correspond to the size of the component assembly, by using some of (e.g., a first group of) the openings in the standard attachment plate to fasten the attachment plate to the component assembly. Then, the attachment plate, with the component assembly fixed thereto, may be attached to the attachment frame by using unused (e.g., a second group of) openings in the attachment plate. This embodiment may provide further cost savings by reducing the number of different attachment plates to be manufactured but may reduce the total number of component assemblies that could be attached to one attachment frame as each of the standard attachment plates may cover unused openings in the attachment frame, thereby reducing the number of openings in the attachment frame for connection with other component assemblies.

The attachment plate may be made of metal, rigid plastic, or other suitable materials. The attachment plate may have one or more cutouts therein to reduce weight and material usage.

Figure 3A:
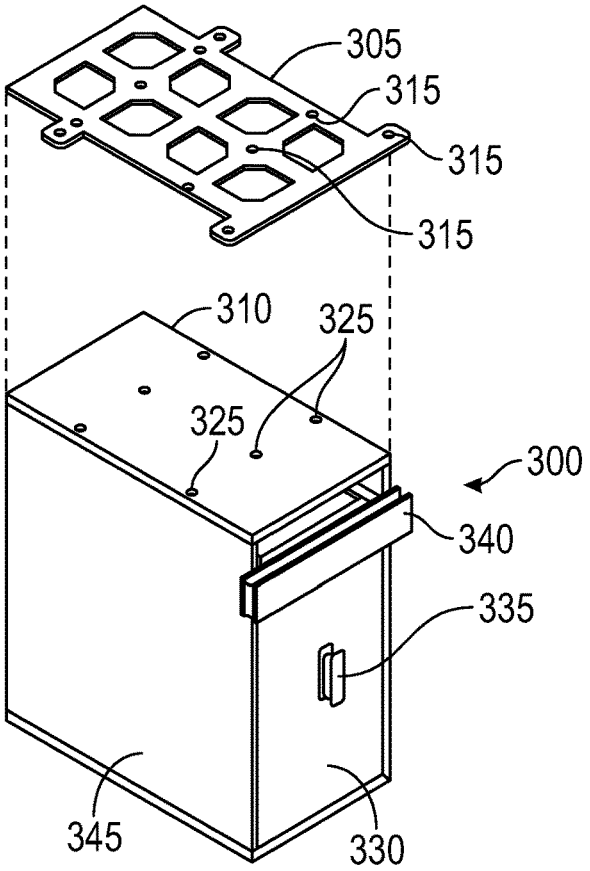
FIGS. 3A-3D show storage compartments and attachment plates according to embodiments of the present disclosure.
Figure 3B:
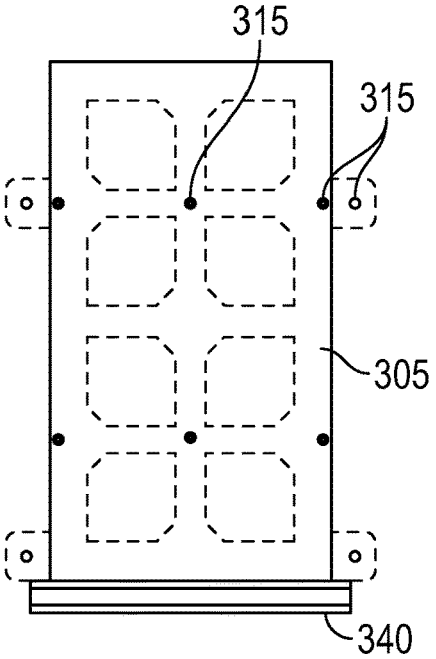

Referring to FIGS. 3A-3D, there may be one or more storage compartments which can be attached to the M. A. P. 100 and desk system. FIG. 3A shows a relatively small storage compartment assembly 300 which may include an attachment plate 305 having a number of openings 315 which correspond to the openings in the M. A. P. 100, as which also correspond to a number of openings 325 in an upper surface 310 of the storage compartment. The openings 325 in the storage compartment upper surface 310 may be threaded holes. FIG. 3B shows a top down view of the relatively small storage compartment assembly 300 which shows the attachment plate 305 connected to the upper surface 310 of the storage compartment 300 with fasteners that pass through the attachment plate openings 315 which overlap with the storage compartment openings 325. The storage compartment assembly 300 may then be attached to the M. A. P. 100 by inserting bolts through attachment plate openings 315 not overlapping the storage compartment 300, and into the threaded holes in the M. A. P. 100.

In another embodiment, bolts may be inserted through the openings 325 in the storage compartment upper surface 310, and directly into the corresponding threaded holes in the M. A. P. 100 as to secure the storage compartment to the desk assembly.

The relatively small storage compartment assembly 300 may further include a box shaped frame 345 defining an enclosed space, a cabinet door 330 permitting access to the storage compartment, and a finishing edge 340 atop the door 330.

Figure 3C:
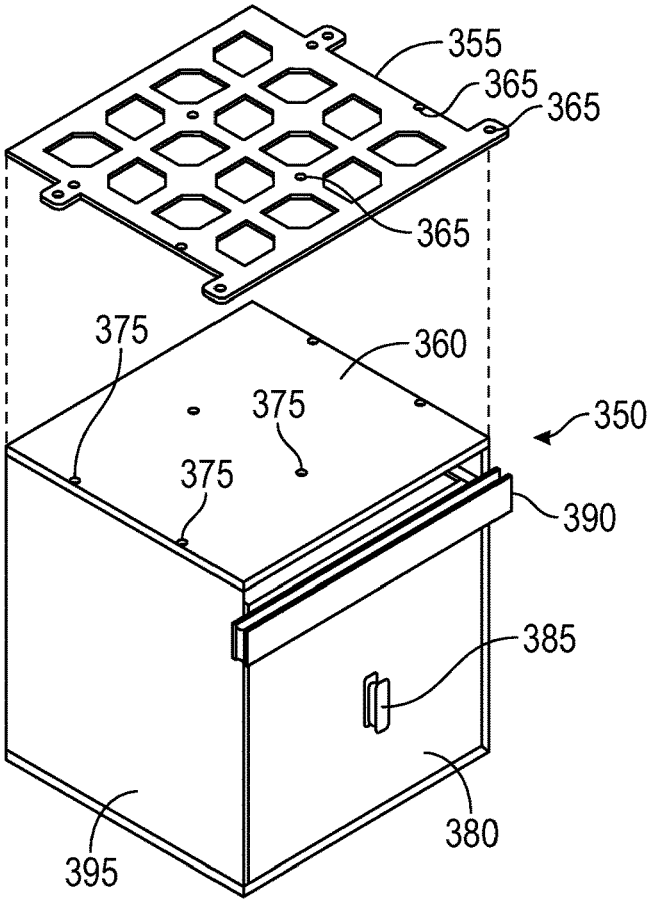
Figure 3D:
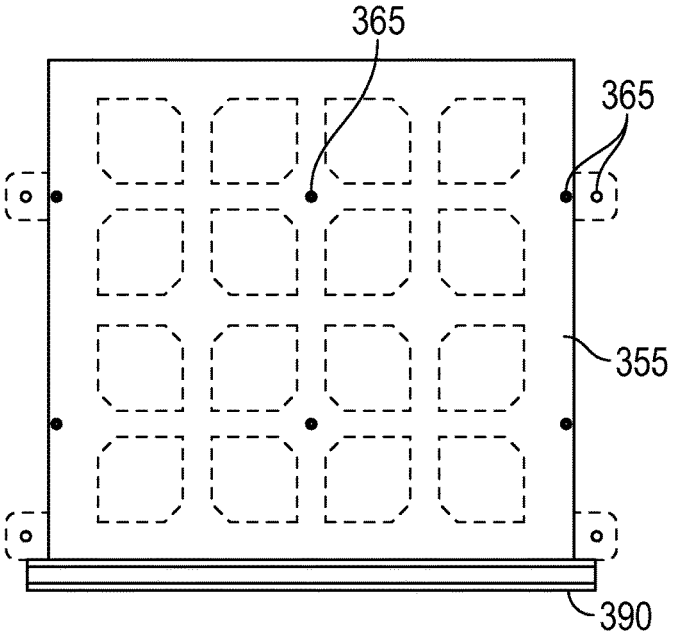

There may be storage compartments of various sizes in the system. FIG. 3C shows a relatively large storage compartment assembly 350 including an attachment plate 350 with a plurality of openings 365, corresponding openings 375 in the upper surface 360 of the relatively large storage compartment, a box shaped frame 395 defining an enclosed space, a door 380, a handle 385, and a finishing edge 390. FIG. 3D shows a top down view of relatively large storage compartment assembly 350, which may be removably attached to the M. A. P. 100 in the same manner as described above using the attachment plate 355 and openings 365 in the attachment plate, which correspond to the openings 375 in the storage compartment, and threaded holes in the M. A. P. 100

Figure 4A:
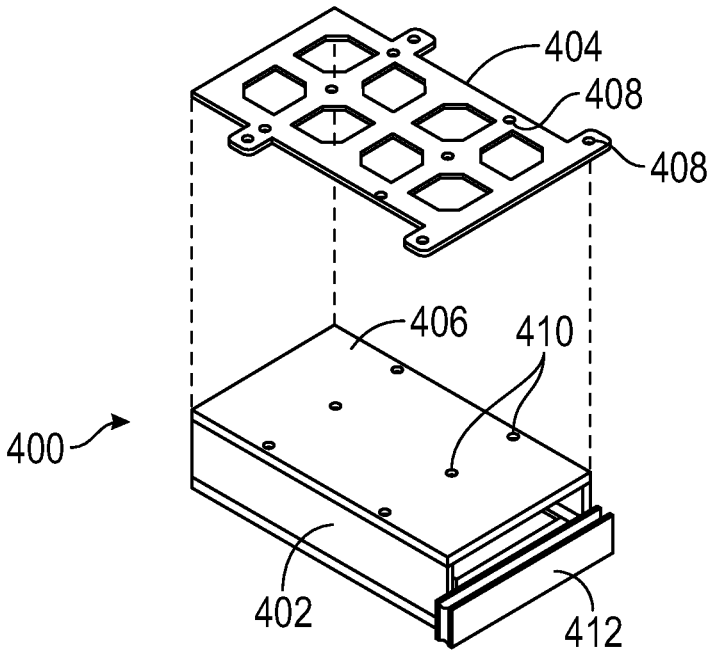
FIGS. 4A-4F show drawers and attachment plates according to embodiments of the present disclosure.
Figure 4B:
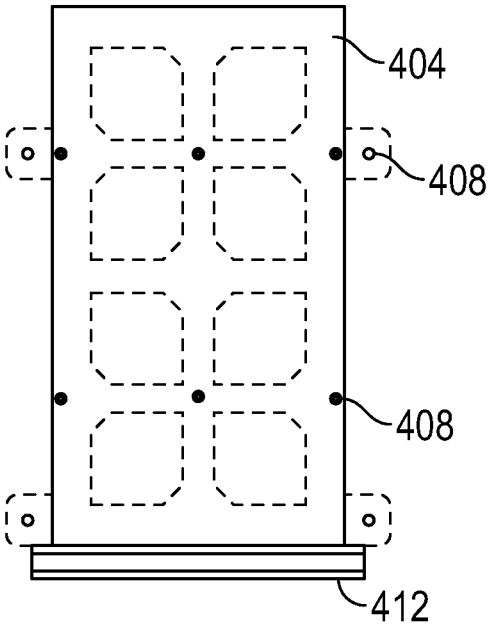

FIGS. 4A-4F show drawer assemblies which may be removably attached to the M. A. P. 100 and desk system. FIG. 4A shows a relatively small drawer assembly 400 including a box shaped frame 402 defining an enclosed space, an attachment plate 404 with correspond openings 408, a plurality of corresponding openings 410 in the upper surface 406 of the frame 402, and a finishing edge 412 which may have a handle. FIG. 4B shows a top down view of the relatively small drawer assembly 400 which may attach to the M. A. P. 100 in the same manner as described above using the attachment plate 404 and openings 408 in the attachment plate, which correspond to the openings 410 in the storage compartment, and threaded holes in the M. A. P. 100.

Figure 4C:
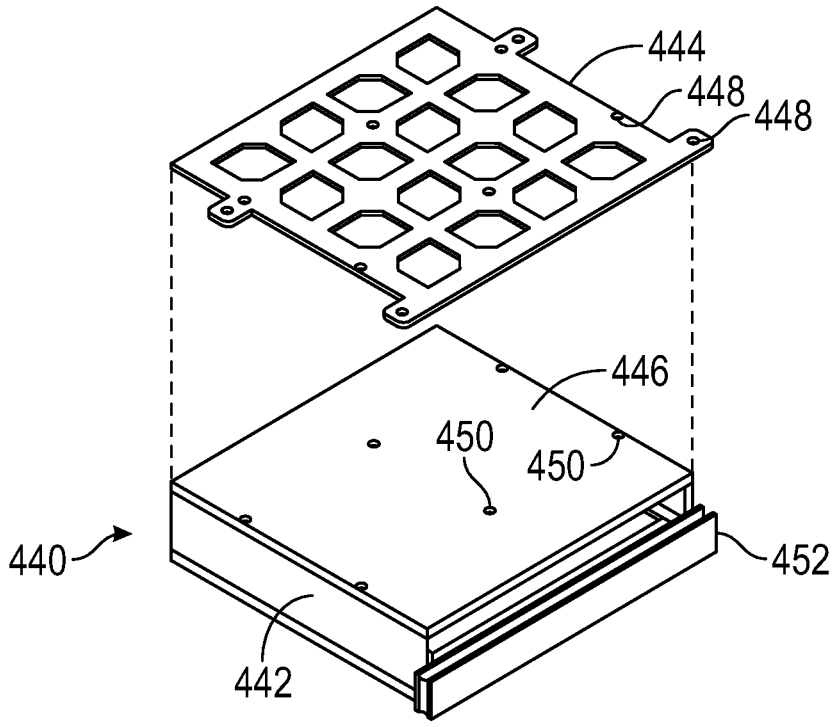
Figure 4D:
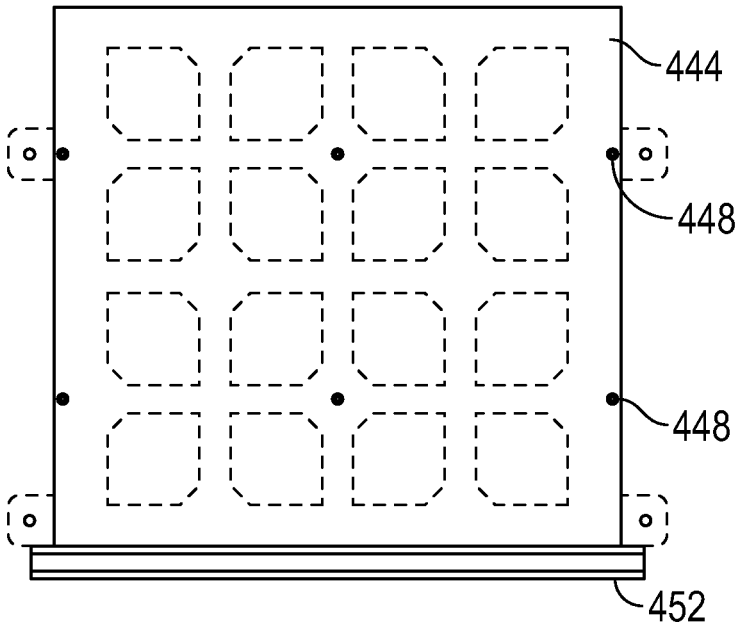

FIGS. 4C-4D show a standard sized drawer assembly 440 similarly including a box shaped frame 442 defining an enclosed space, an attachment plate 444 with corresponding openings 448, a plurality of corresponding openings 450 in the upper surface 446 of the frame 442, and a finishing edge 452 which may also serve as a handle. FIG. 4D shows a top down view of the standard drawer assembly 400 which may be removably attached to the M. A. P. 100 in the same manner as described above using the attachment plate 444 and openings 448 in the attachment plate, which correspond to the openings 450 in the storage compartment, and threaded holes in the M. A. P. 100.

Figure 4E:
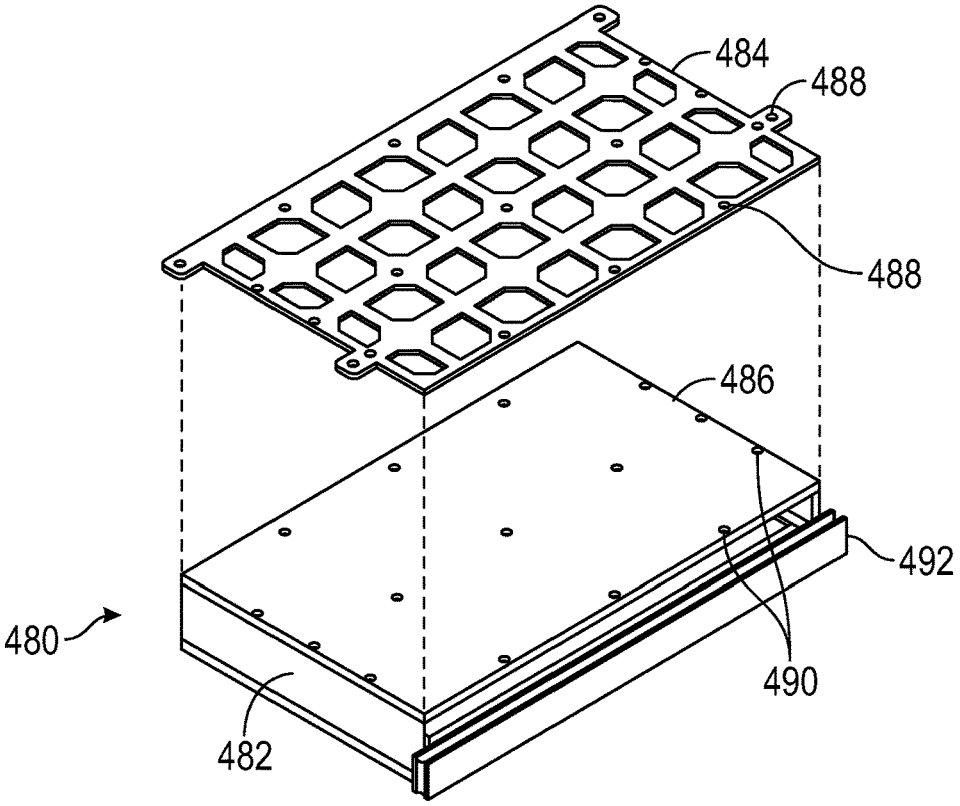
Figure 4F:
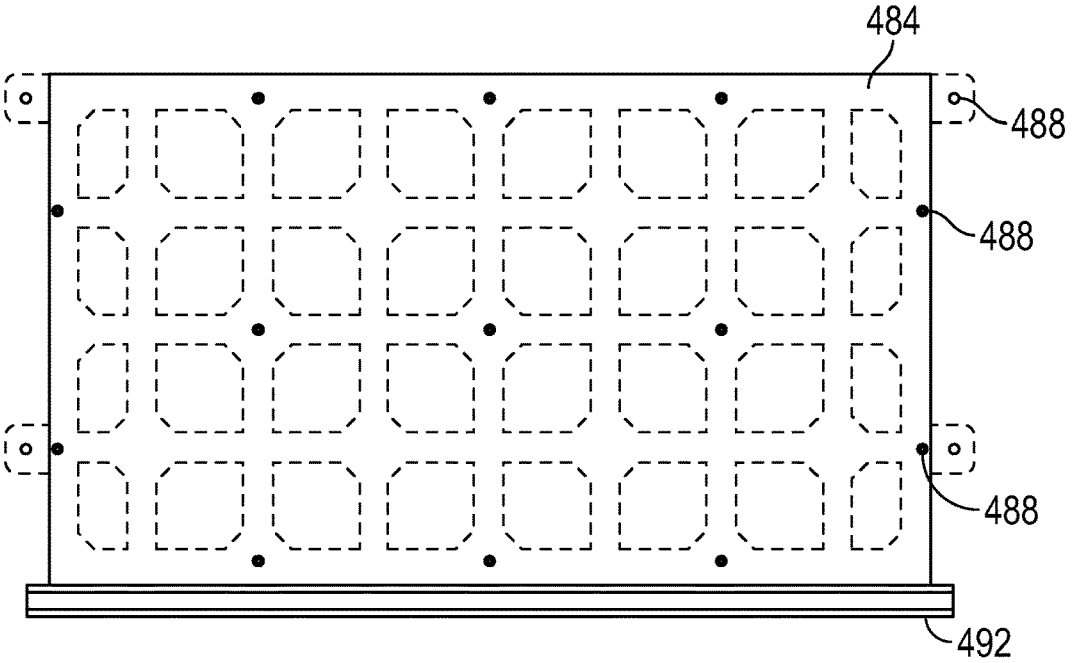

FIGS. 4E-4F shows a wide drawer assembly 480, suitable for use as a keyboard drawer. The wide drawer assembly 480 may include a box shaped frame 482 defining an enclosed space, an attachment plate 484 with corresponding openings 488, a plurality of corresponding openings 490 in the upper surface 486 of the frame 442, and a finishing edge 492 which may include a handle. FIG. 4F shows a top down view of the wide drawer assembly 480 which attaches to the M. A. P. 100 in the same manner as described above using the attachment plate 484 and openings 488 in the attachment plate, which correspond to the openings 490 in the storage compartment, and threaded holes in the M. A. P. 100.

Referring to FIGS. 5A-5L, component assemblies include, as some examples, an L-shaped leg assembly, a T-shaped leg assembly, a square leg assembly, an X-shaped leg assembly, etc., a post (or straight) leg, a flat panel leg, a kinetic leg assembly, which may include one or more actuators to raise and/or lower the table top, a modesty panel, a privacy panel, a back panel, a drawer, a drawer set, cubbies, etc. In some cases, stand-off posts may be used to provide a "floating" drawer, shelf, cubby, etc.

FIGS. 5A-5E show examples of various L shaped legs assemblies. The various leg assemblies may attach to the M. A. P. 100 using attachment plates with corresponding openings which align with the threaded holes in the M. A. P. 100.

Figure 5B:
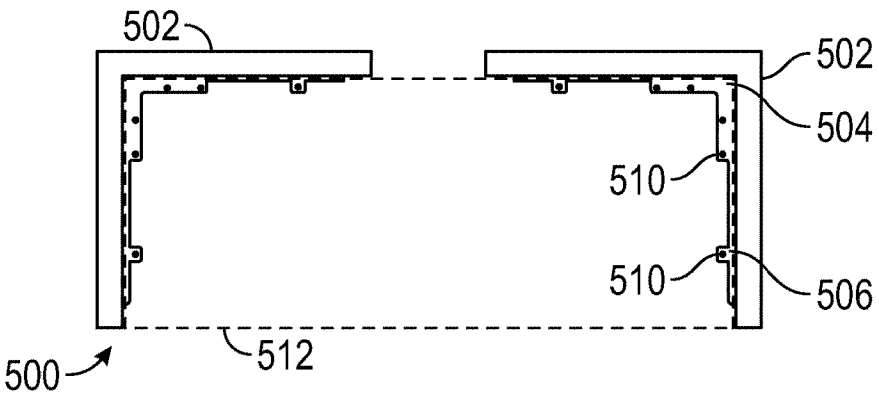
FIG. 5A-5L show leg attachments and attachment plates according to embodiments of the present disclosure.
Figure 5D:
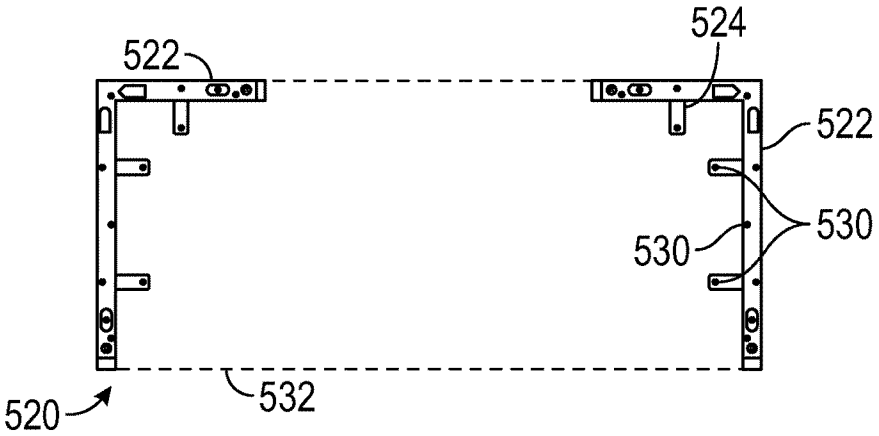
Figure 5A:
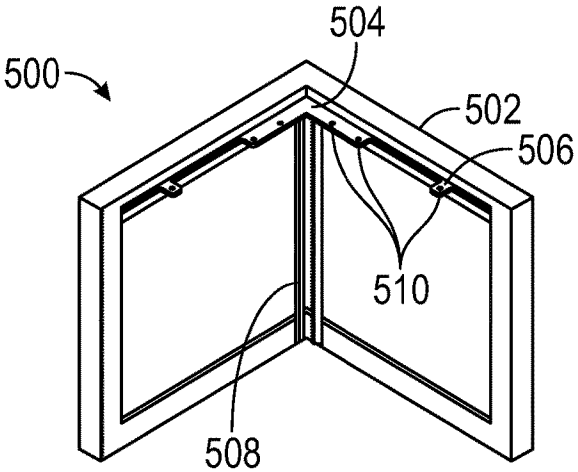

FIG. 5A shows an equilateral L shaped leg 500 including an equilateral L shaped frame 502 with legs of equal length, attachment plates 504/506, a plurality of openings 510 in the attachment plates, and a cross member 508. FIG. 5B shows an example configuration of equilateral L shaped legs 500 being used to support a desktop 512 between them.

Figure 5C:
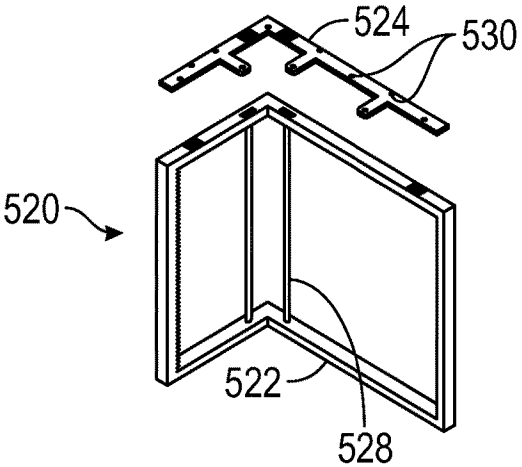

FIG. 5C shows a standard L shaped leg assembly 520 including a standard L frame 522, a removable attachment plate 524 with corresponding openings 530, and a cross member 528. FIG. 5D shows the shows an example configuration of standard L shaped legs 520 with a desktop 532 supported above the legs. The orientation of the standard L shaped legs 520 may be reversible.

Figure 5E:
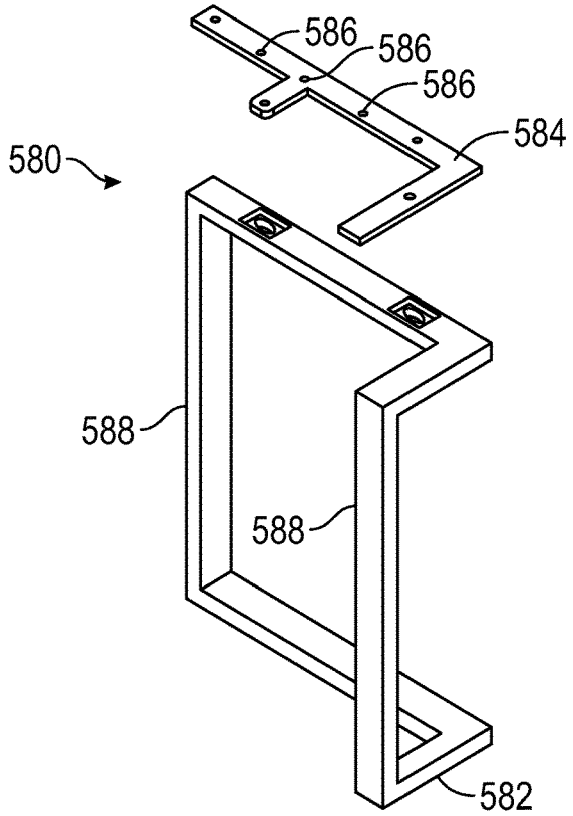
Figure 5F:
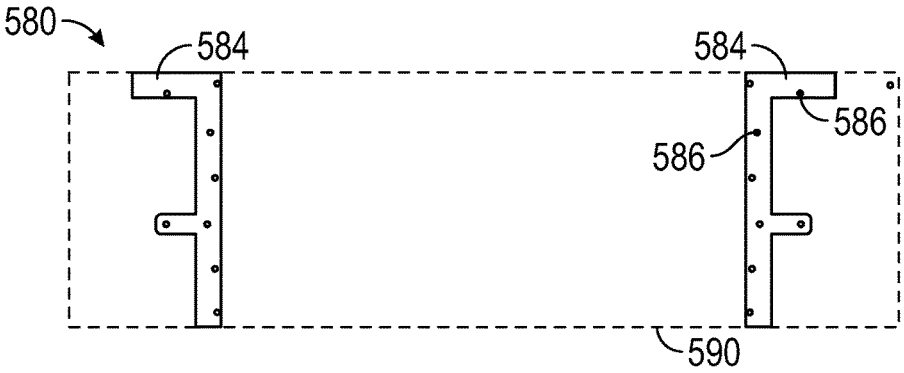
Figure 5G:
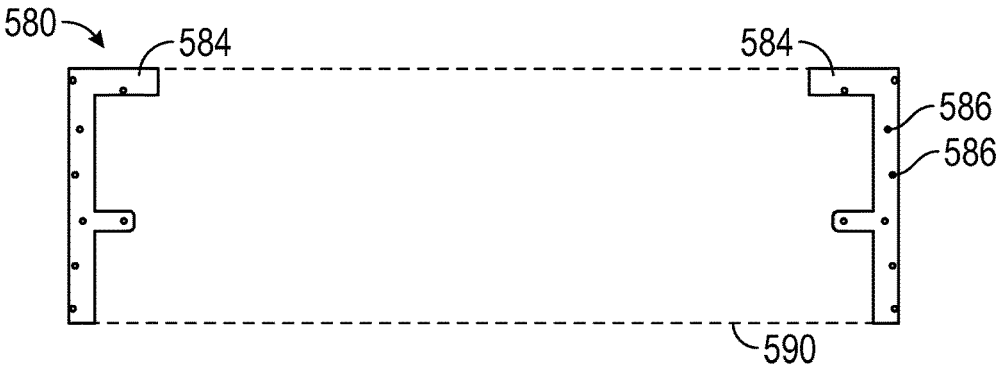

FIG. 5E shows a narrow L shaped leg assembly 580 including a standard L frame 582, a removable attachment plate 584 with corresponding openings 586, and a cross member 588. FIGS. 5F and 5G shows the shows an example configuration of narrow L shaped legs 580 with a desktop 590 supported above the legs. The orientation of the standard L shaped legs 580 may be reversible, as is shown in FIG. 5F.

Figure 5H:
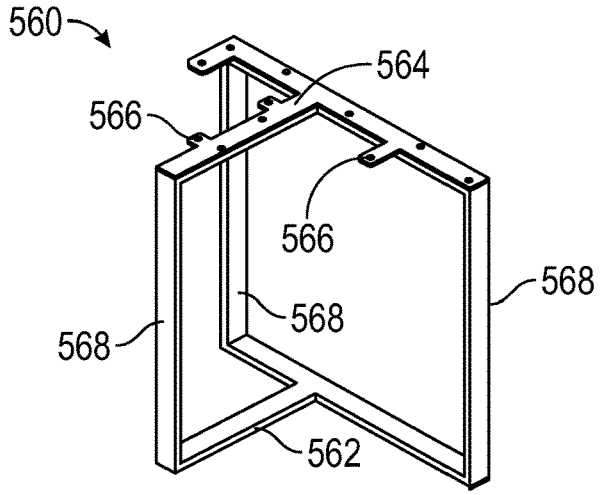
Figure 5I:
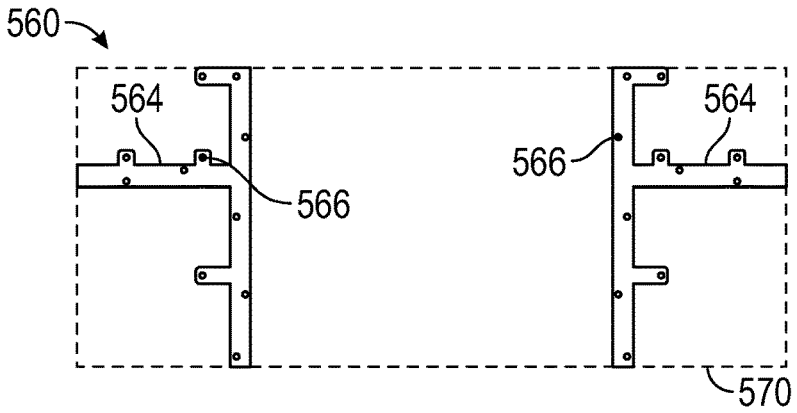
Figure 5J:
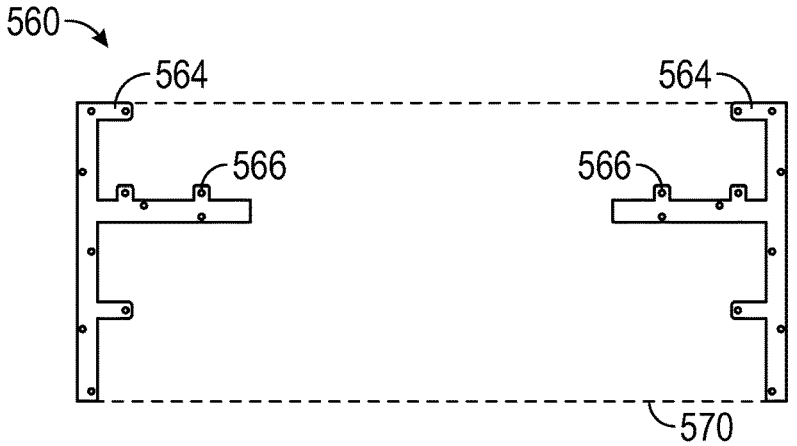

FIGS. 5H-5J show T shaped leg assemblies. FIG. 5H shows a T shaped leg 560 including a T shaped frame 562, an attachment plate 564 having corresponding openings 566, and a plurality of cross members 568. FIGS. 5H-5J show example configurations of the T shaped leg assemblies with a desktop 570 supported above the legs. The orientation of the T shaped legs 560 may be reversible, as is shown in FIG. 5I.

Figure 5K:
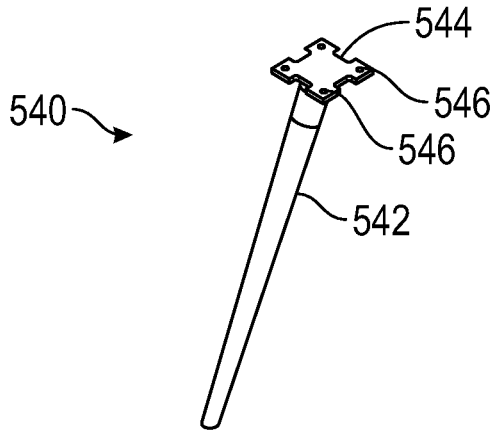
Figure 5L:
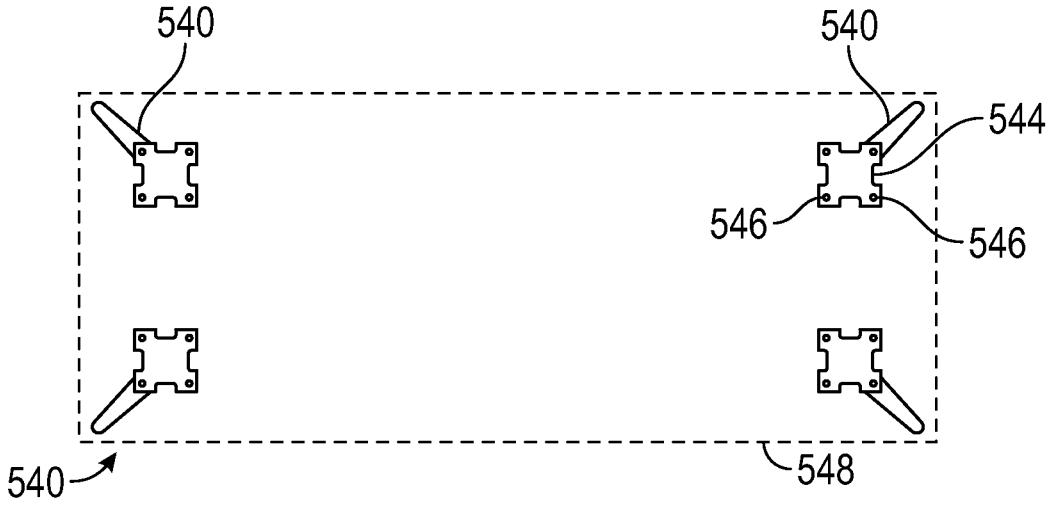
Figure 6A:
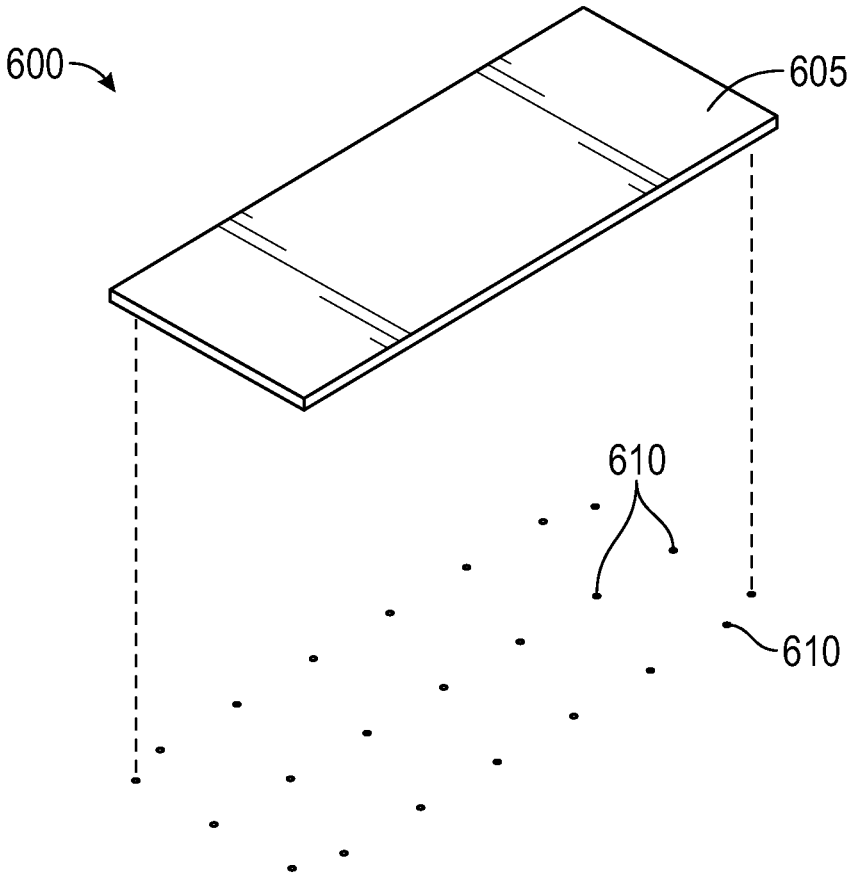
FIG. 6A-6D show desktop surface components according to embodiments of the present disclosure.
Figure 6B:
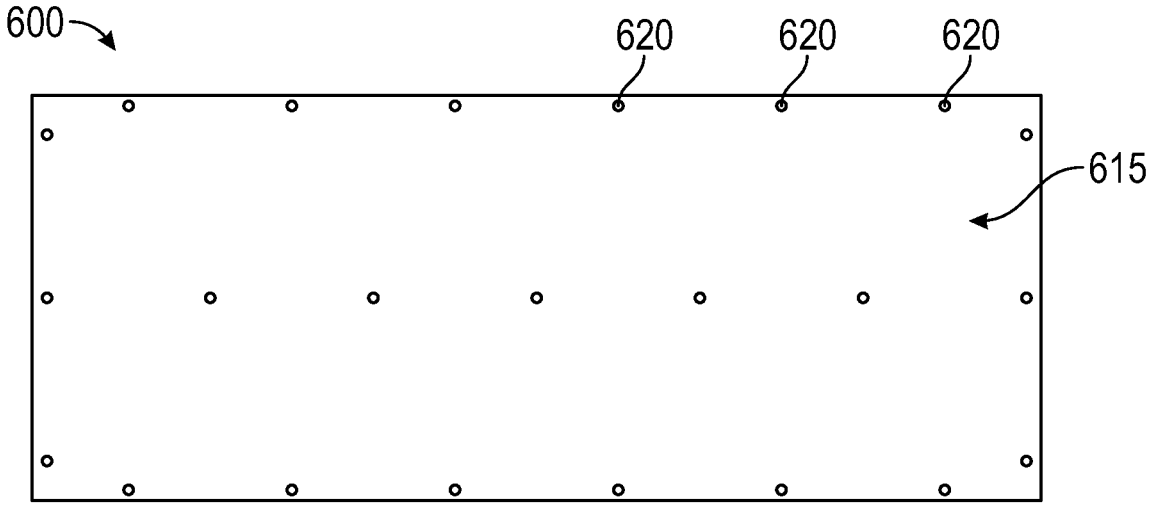
Figure 6C:
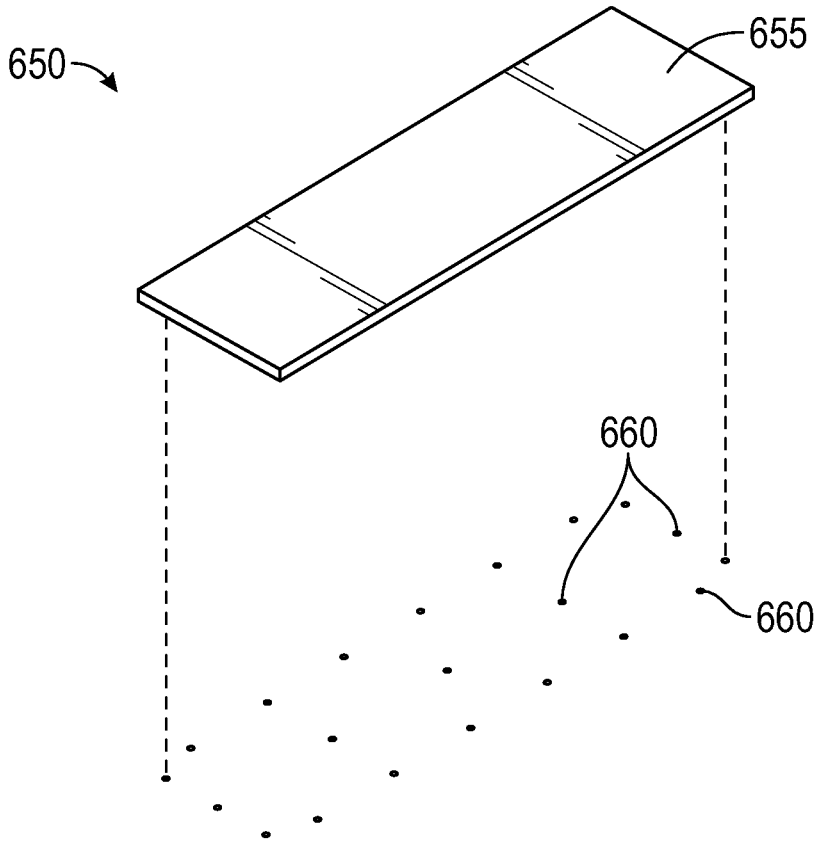
Figure 6D:
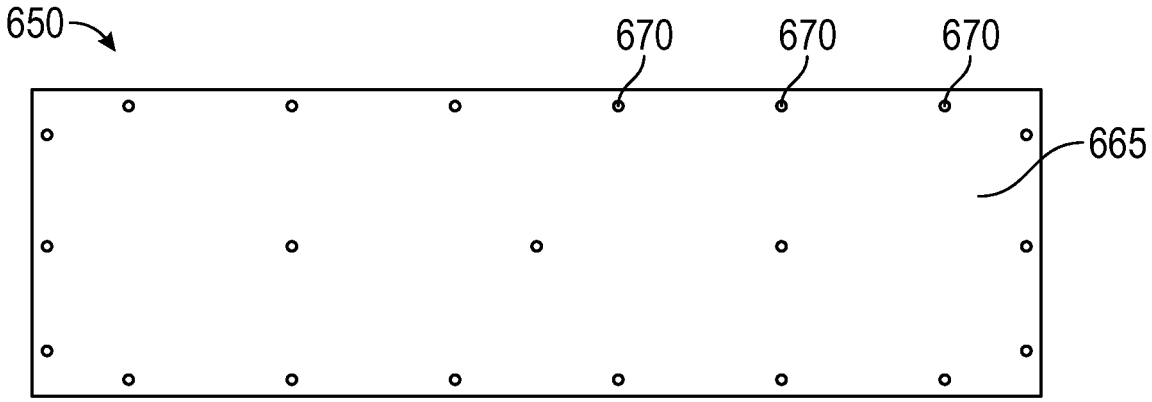

FIGS. 5K-5L show post shaped leg assemblies. FIG. 5K shows a post shaped leg 540 including a generally straight body 542, and an attachment plate 544 having a plurality of openings 546. The post shaped leg 540 may then attach to the M. A. P. 100 and support a desktop 548 above as shown in FIG. 5L. The post need not be cylindrical, and can be any shape.

Figure 7A:
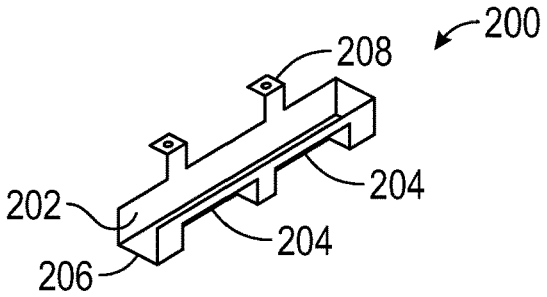
FIG. 7A-7B show cable tray attachments according to embodiments of the present disclosure.
Figure 7B:
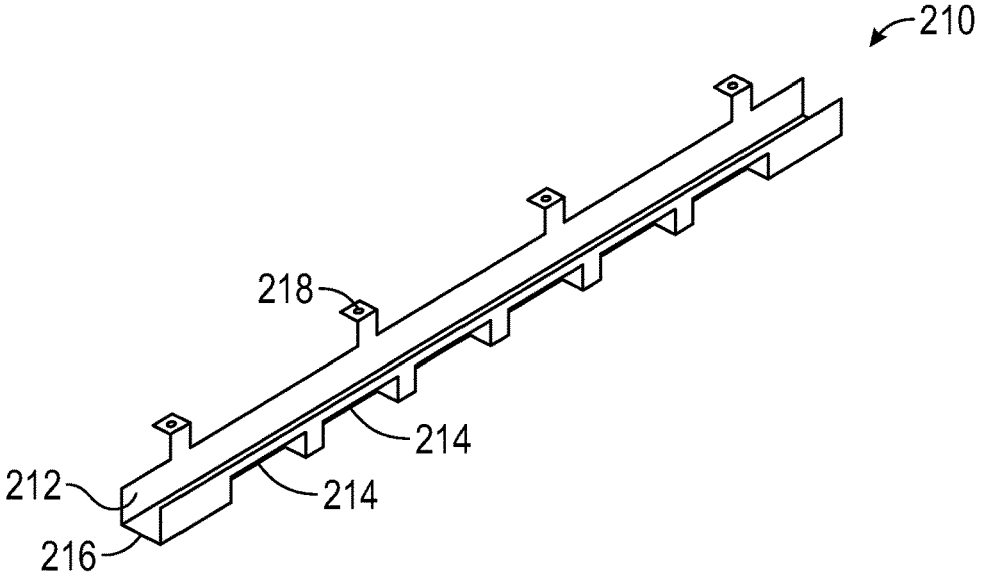

FIGS. 7A-7F show various attachment plates and trays which can be used with the desktop according to embodiments of the present disclosure. FIG. 7A shows a cable tray 200 having a flat back section 202, a corrugated center piece 206 positioned normal to the flat back section 202 which defines a plurality of openings 204, and corresponding openings 208 which allow the tray to attach to the M. A. P. 100 FIG. 7B shows a cable tray 210 which similarly includes a flat back section 212, a corrugated center piece 216 positioned normal to the flat back section 212 which defines a plurality of openings 214, and corresponding openings 218 which allow the tray to attach to the M. A. P. 100.

Figure 7C:
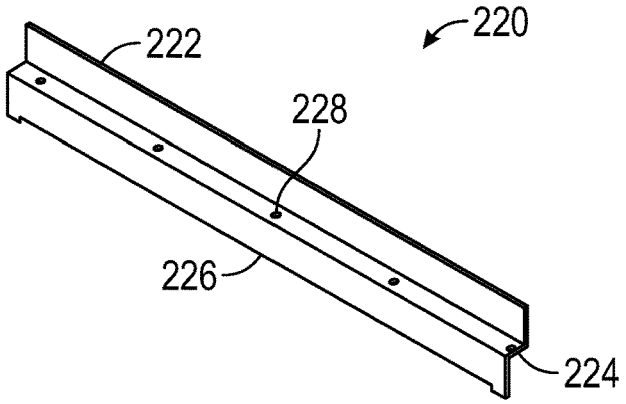
FIG. 7C-7F show various attachment plates according to embodiments of the present disclosure.

FIG. 7C shows a folder rail 220 having a vertical connecting edge 222 with corresponding openings 228 which allow the rail to be removably attached to the M. A. P. 100, a connecting ridge 224 which is positioned normal to the vertical connecting edge 222, and normal to the hanging rail 226 upon which folders can be placed. Two such rails 220 can be placed on the M. A. P. 100 facing each other to hang folders between them.

Figure 7D:
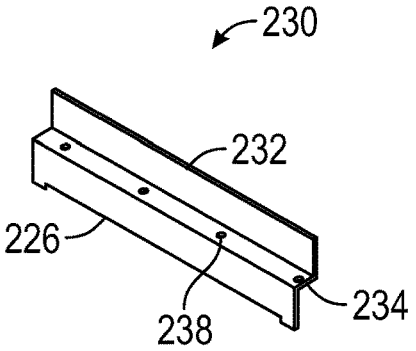

FIG. 7D shows a folder rail having a vertical connecting edge 232 with corresponding openings 238 which allow the rail to attach to the M. A. P. 100, a connecting ridge 234 which is positioned normal to the vertical connecting edge 232, and normal to the hanging rail 236 upon which folders can be placed. Two such rails 230 can be placed on the M. A. P. 100 facing each other to hang folders between them.

Figure 7E:
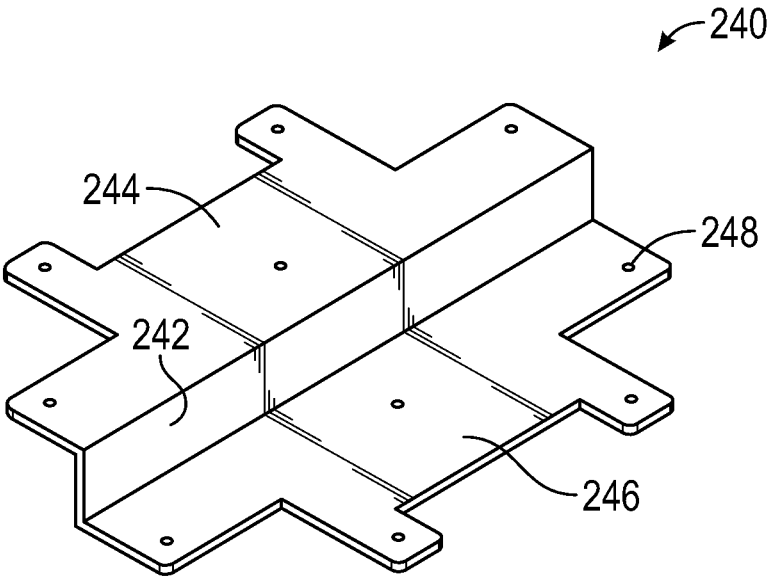

FIG. 7E shows a multilevel attachment plate 240 which allows for multiple M. A. P.s 100/150 to be attached together. The multilevel attachment plate 240 has a first upper flat surface 244 connected to a second lower flat surface 246 by a connecting ridge 242 which positioned normal to each flat surface 244/246. There may be a plurality of corresponding openings 248 in the multilevel attachment plate 240 to permit it to be attached to the M. A. P.s 100/150. For example, one M. A. P. 100 may attach to the corresponding openings 248 on the second lower flat surface 246, while the other M. A. P. 150 may attach to the corresponding openings 248 on the first upper flat surface 244.

Figure 7F:
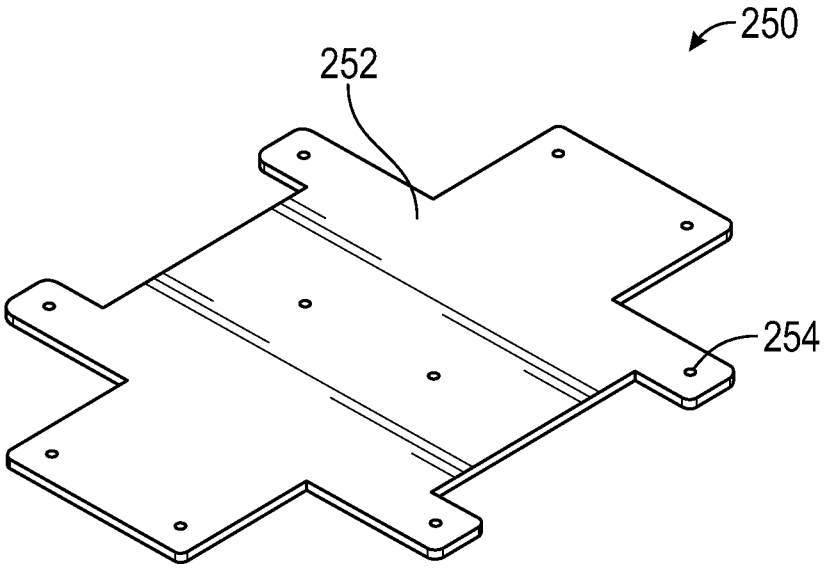

FIG. 7F shows a standard attachment plate 250 having a flat surface 252 with a plurality of corresponding openings 254. It may be used to attach a variety of the components disclosed herein.

Figure 8A:
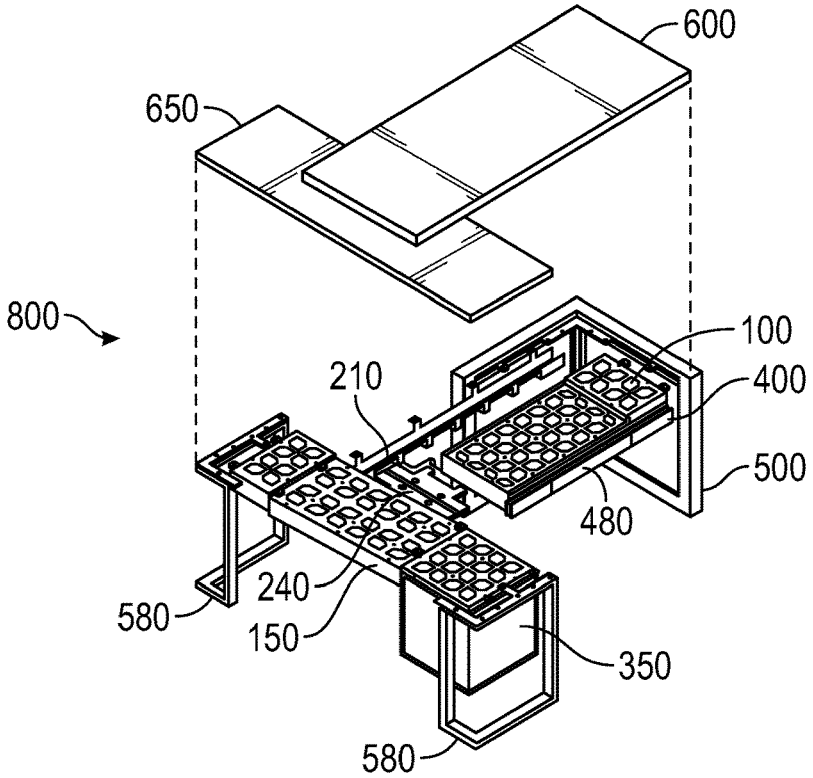
FIG. 8A-8C show an example T shaped desk configuration modular component desk according to embodiments of the present disclosure.
Figure 8B:
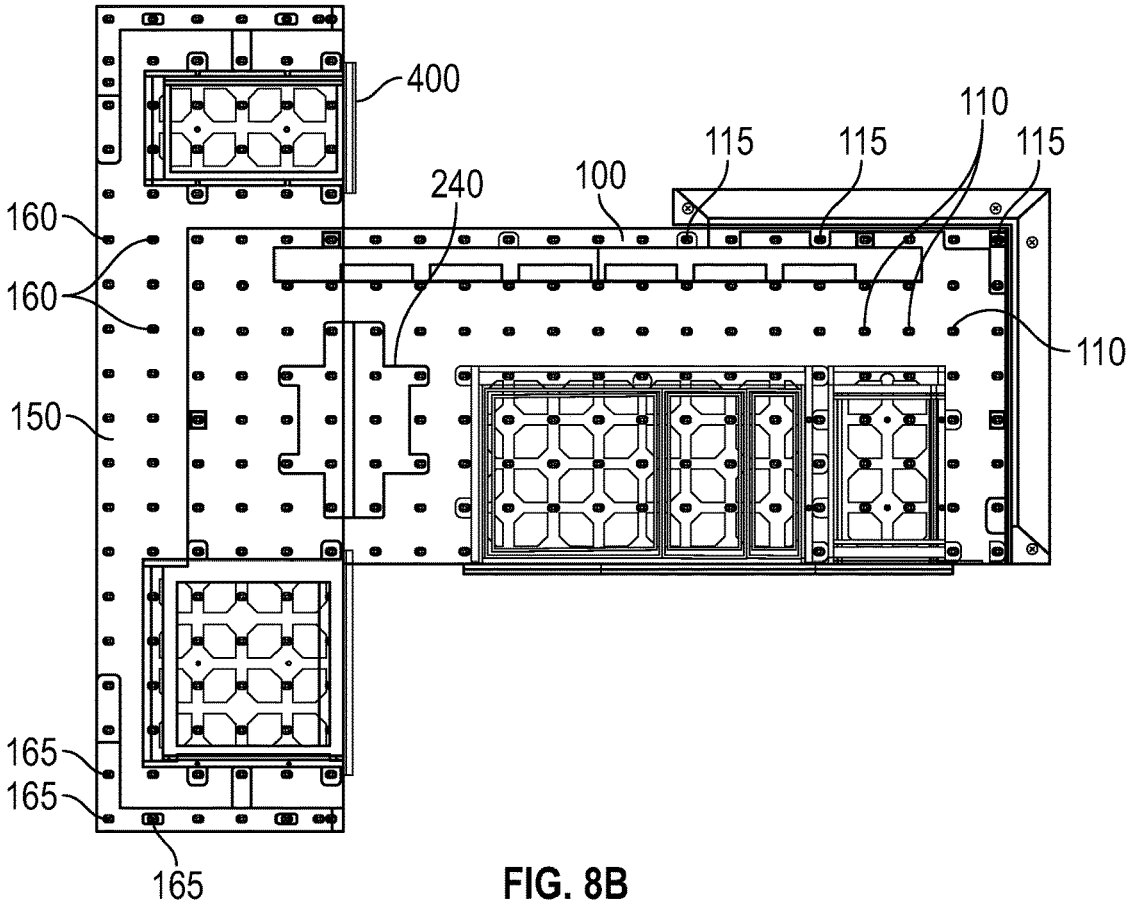
Figure 8C:
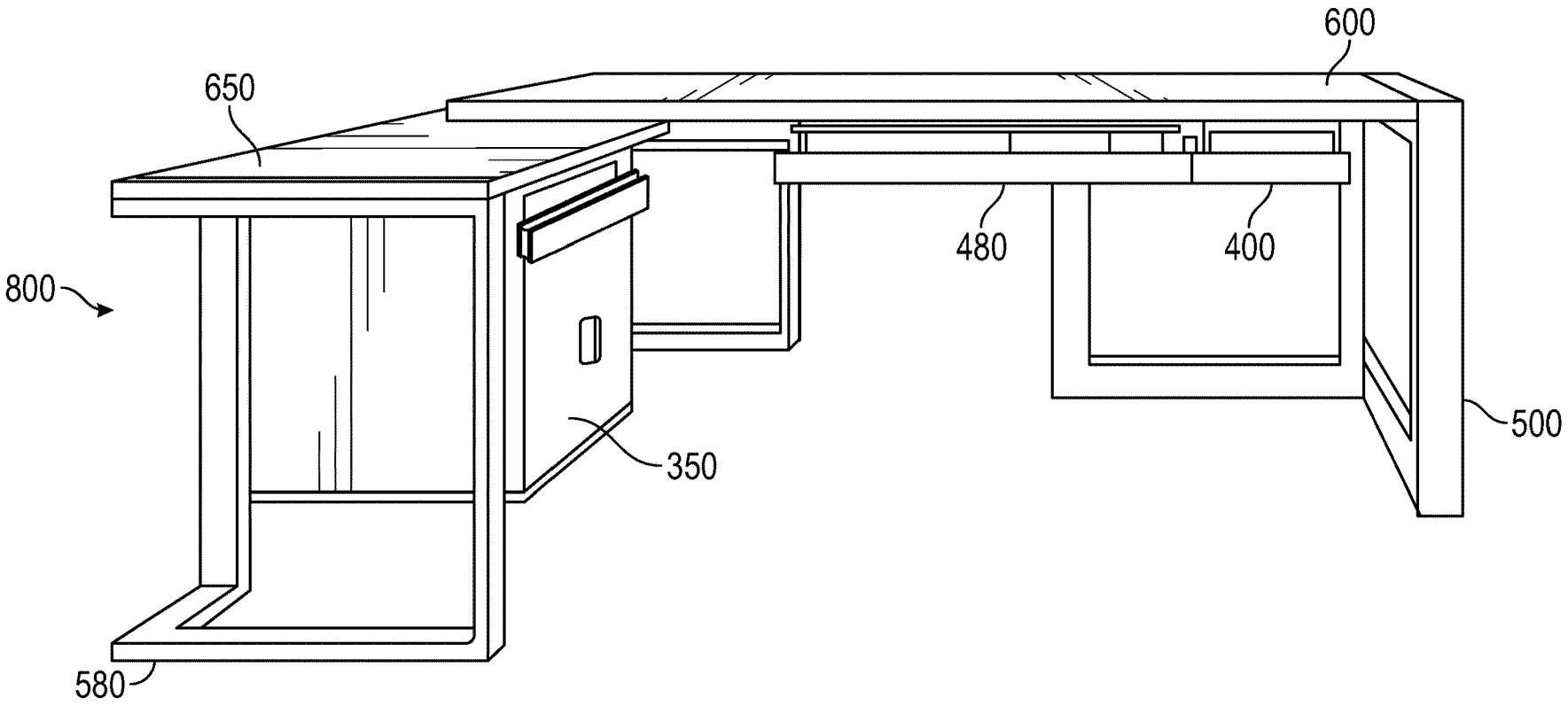

FIG. 8A-8C show an example T shaped desk configuration of the modular component desk according to embodiments of the present disclosure. FIG. 8A shows an exploded view, FIG. 8B shows a cross sectional view, and FIG. 8C shows a perspective view of the T shaped desk configuration 600. In such a configuration, as a non-limiting example, two separate M. A. P.s and desktop assemblies, such as the M. A. P. 100 and desktop 600 and the M. A. P. 150 and desktop 650, are linked together using the multilevel attachment plate 240 to connect the M. A. P.s 100/150. The M. A. P. 100 and desktop 600 assembly are configured with a wide drawer 480, relatively small drawer 400, cable tray 210, and one equilateral L shaped leg 500. The M. A. P. 150 and desktop 650 are configured with two narrow L shaped legs 580, a relatively small drawer 400 on one side, and a relatively large storage compartment 350 on the opposite side. The linking of the M. A. P.s 100/150 together using the narrower M. A. P. 150 supports the left side of the M. A. P. 100 and the desktop 600 such that only a single equilateral L shaped leg 500 is used. FIG. 8C shows a perspective view of how the example T shaped desk configuration may look from the front side.

Figure 9A:
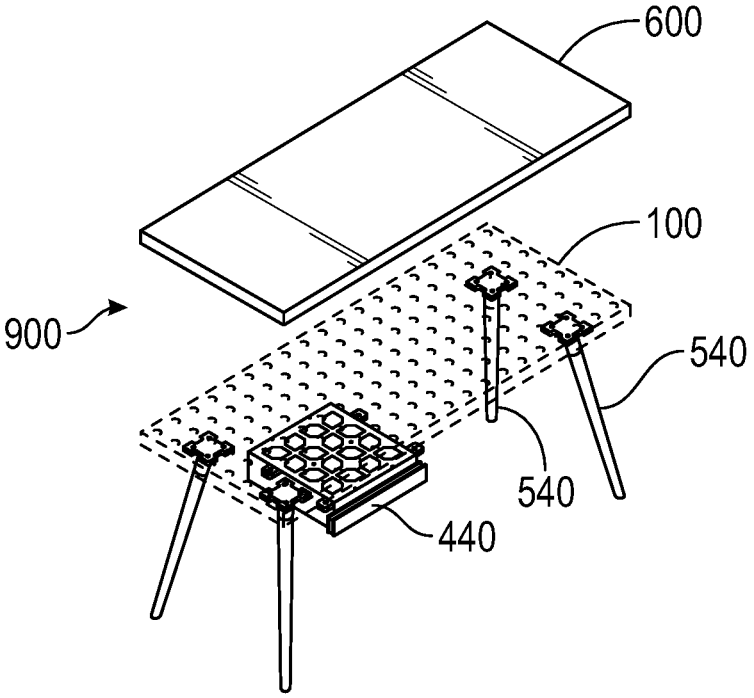
FIG. 9A-9C show an example configuration of the modular component desk with post legs according to embodiments of the present disclosure.
Figure 9B:
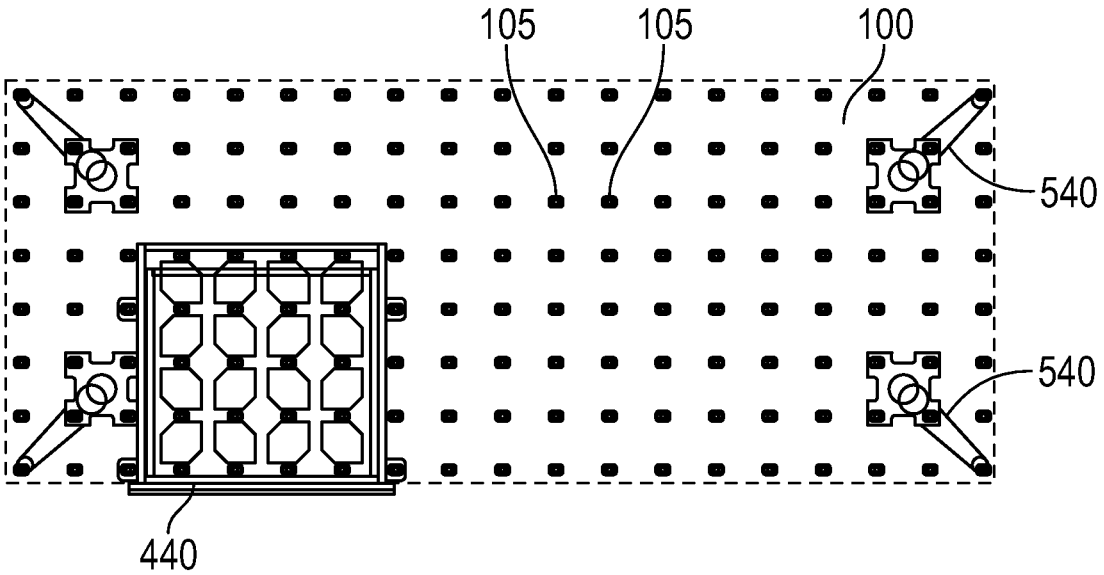
Figure 9C:
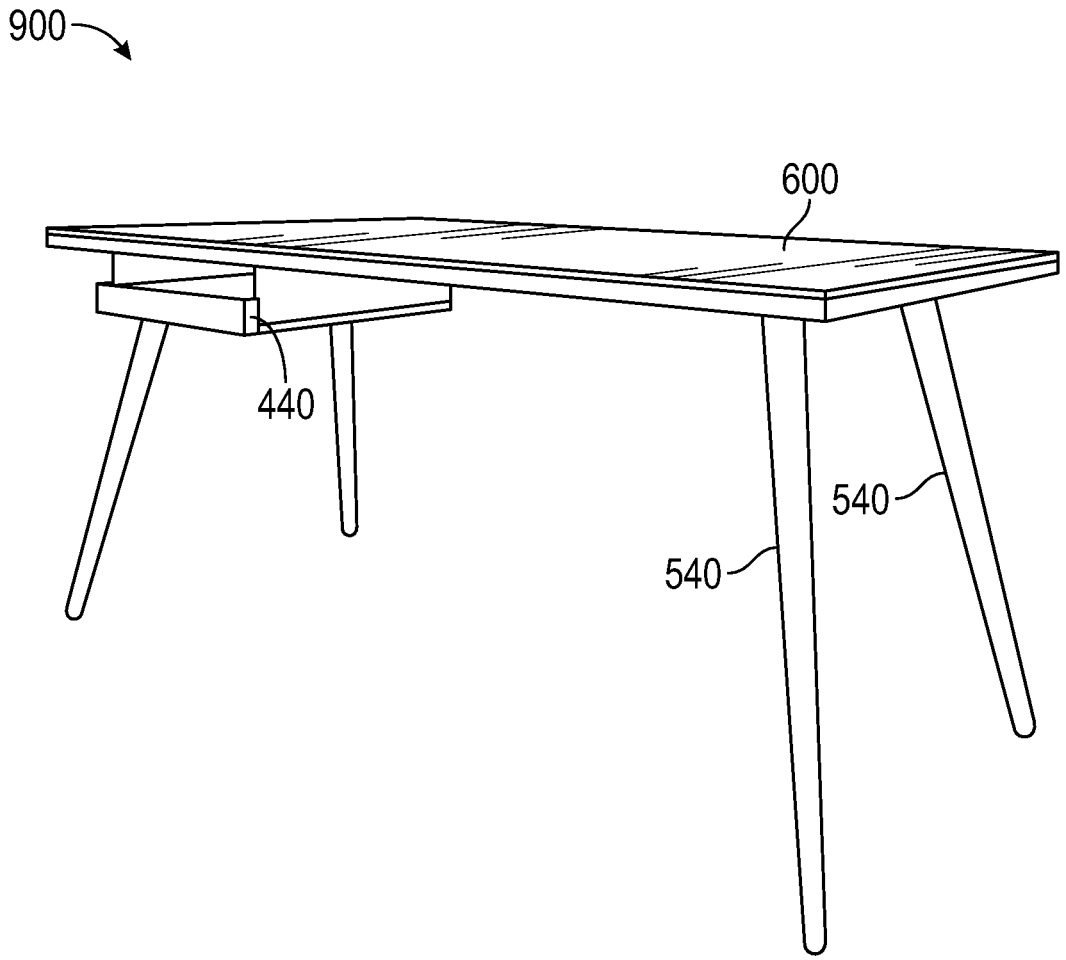

FIGS. 9A-9C show an example desk configuration modular component desk according to embodiments of the present disclosure with post legs. FIG. 9A shows an exploded view, FIG. 9B shows a cross sectional view, and FIG. 9C shows a perspective view of the post leg configuration 900. Shown in these views, as a non-limiting example, is a M. A. P. 100, a desktop 600, four post legs 540, and a drawer attachment 400. Such a post leg configuration 900 may be considered a minimalist desk design.

Figure 10A:
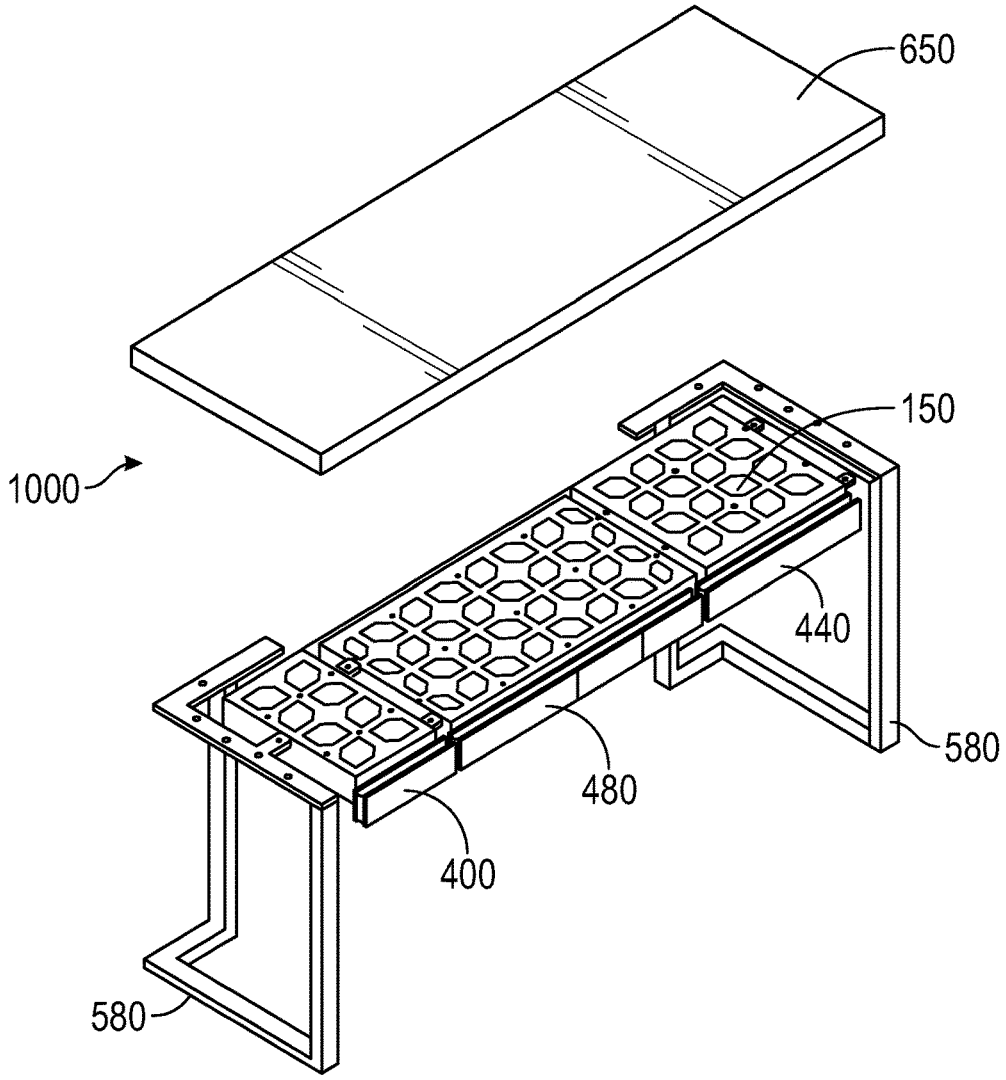
FIG. 10A-10C show an example modular component desk configuration according to embodiments of the present disclosure with narrow L legs.
Figure 10B:
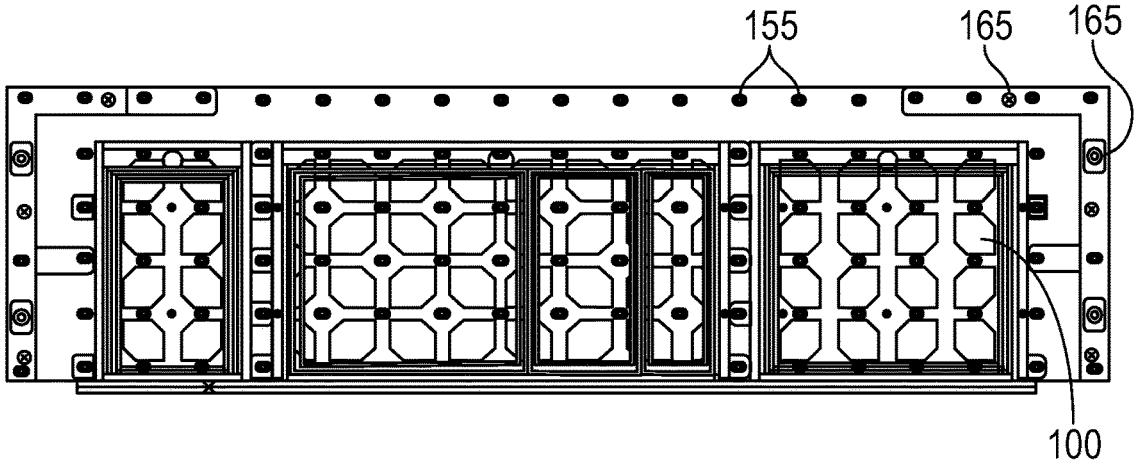
Figure 10C:
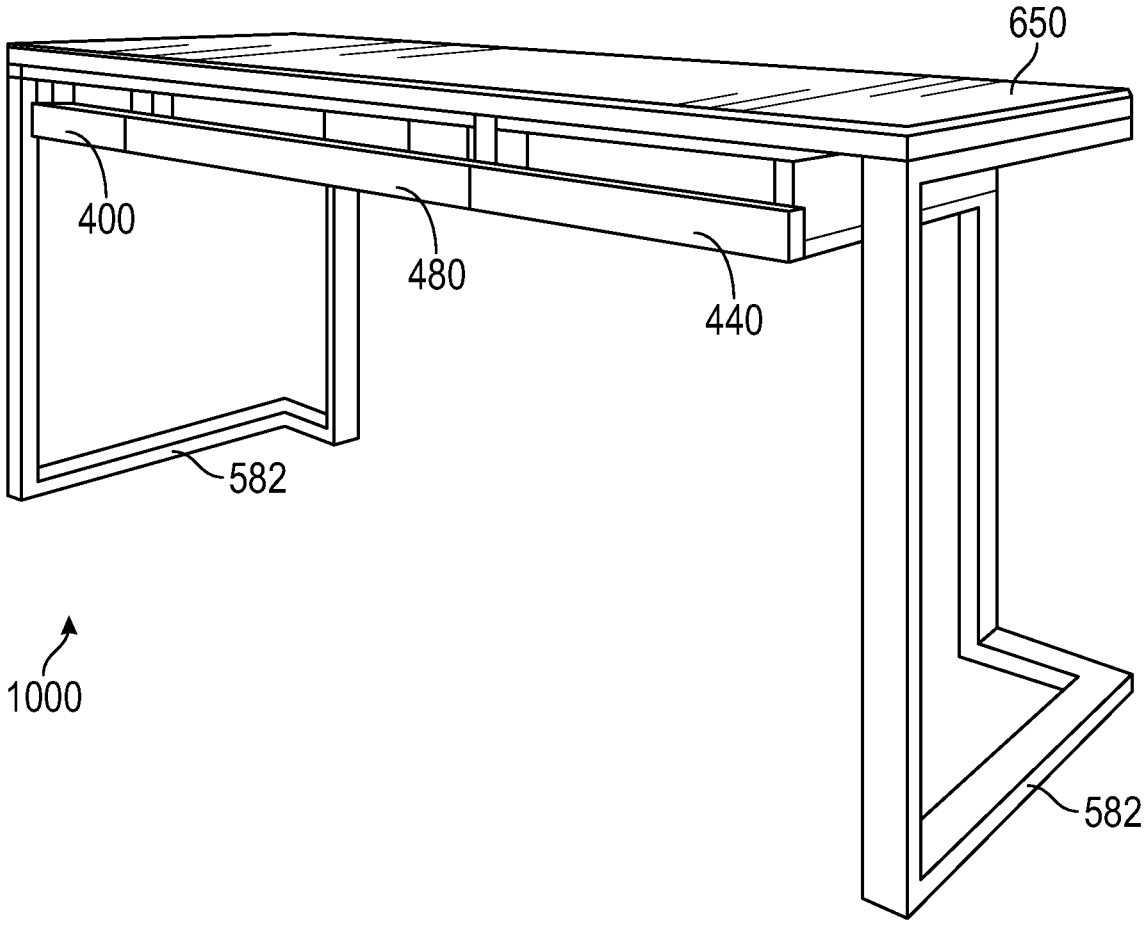

FIGS. 10A-10C show an example desk configuration modular component desk according to embodiments of the present disclosure with narrow L legs. FIG. 10A shows an exploded view, FIG. 10B shows a cross sectional view, and FIG. 10C shows a perspective view of the narrow desk configuration 1000. Shown in these views, as a non-limiting example, is the M. A. P. 150, narrow desktop 650, a relatively small drawer 400, a standard drawer 440, and a wide drawer 480, sitting atop narrow L legs 580. The narrow desktop 650 sits with the edge extending over the narrow L legs 580, as to take up as little space as possible. Such a narrow desk configuration 1000 may be used in smaller spaces.

According to embodiments of the present disclosure, a single attachment frame can be the backbone of any number of possible desk configurations by allowing various component assemblies to be attached thereto in various orientations. In this way, a large organization could purchase a number of attachment frames and component assemblies and allow employees to individually customize their own desks and freely re-configure their desks over time as their desires change without having to purchase entirely new desks. For example, a person could easily change the leg assemblies for a new aesthetic appearance or change a static leg assembly to a kinetic leg assembly to provide a sit/stand desk. As another example, a person could add a drawer set to increase storage space or remove a drawer set to provide additional leg room.

In other embodiments, the table top and the attachment frame may be a single component (e.g., may be integrated with each other). For example, the attachment frame may be a flat or substantially flat piece of wood, laminate, (e.g., engineered wood), plastic, etc. with a two-dimensional matrix of threaded openings in a lower surface thereof into which various component assemblies can be attached, and the table top may be a relatively thin (e.g., thinner than the attachment frame) veneer that is attached (e.g., screwed, glued, etc.) to the attachment frame to form an integral table top and attachment frame. The threaded inserts may be metal for increased durability, and the threaded inserts may be glued into openings (e.g., holes or blind holes) in the bottom surface of the attachment frame.

Although aspects and features of the modular component desk have been described in connection with a desk that may be found in, for example, an office environment, this is not intended to, nor should it, limit the present disclosure. Aspects and features of the present disclosure may be used in various other industries and settings, such as dining tables (at home or in restaurants), agricultural uses, manufacturing environments, etc., as would be understood by one skilled in the relevant art. One of ordinary skill in the art will recognize that the inventive principles disclosed are not limited to the embodiments disclosed herein, and that various aspects of the disclosed embodiments can be combined to achieve additional embodiments.

It will be understood that when an element or layer is referred to as being "on," "connected to," or "coupled to" another element or layer, it may be directly on, connected, or coupled to the other element or layer or one or more intervening elements or layers may also be present. When an element or layer is referred to as being "directly on," "directly connected to," or "directly coupled to" another element or layer, there are no intervening elements or layers present. For example, when a first element is described as being "coupled" or "connected" to a second element, the first element may be directly coupled or connected to the second element or the first element may be indirectly coupled or connected to the second element via one or more intervening elements.

In the figures, dimensions of the various elements, layers, etc. may be exaggerated for clarity of illustration. The same reference numerals designate the same elements. As used herein, the term "and/or" includes any and all combinations of one or more of the associated listed items. Further, the use of "may" when describing embodiments of the present invention relates to "one or more embodiments of the present invention." Expressions, such as "at least one of," when preceding a list of elements, modify the entire list of elements and do not modify the individual elements of the list. Also, the term "exemplary" is intended to refer to an example or illustration. As used herein, the terms "use," "using," and "used" may be considered synonymous with the terms "utilize," "utilizing," and "utilized," respectively. As used herein, the terms "substantially," "about," and similar terms are used as terms of approximation and not as terms of degree, and are intended to account for the inherent variations in measured or calculated values that would be recognized by those of ordinary skill in the art.

It will be understood that, although the terms first, second, third, etc. may be used herein to describe various elements, components, regions, layers, and/or sections, these elements, components, regions, layers, and/or sections should not be limited by these terms. These terms are used to distinguish one element, component, region, layer, or section from another element, component, region, layer, or section. Thus, a first element, component, region, layer, or section discussed below could be termed a second element, component, region, layer, or section without departing from the teachings of example embodiments.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" or "over" the other elements or features. Thus, the term "below" may encompass both an orientation of above and below. The device may be otherwise oriented (rotated 90 degrees or at other orientations), and the spatially relative descriptors used herein should be interpreted accordingly.

The terminology used herein is for the purpose of describing particular example embodiments of the present invention and is not intended to be limiting of the described example embodiments of the present invention. As used herein, the singular forms "a" and "an" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components but do not preclude the presence or addition of one or more other features, integers, steps, operations, elements, components, and/or groups thereof.

Also, any numerical range disclosed and/or recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein, and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein. All such ranges are intended to be inherently described in this specification such that amending to expressly recite any such subranges would comply with the requirements of 35 U.S.C. § 112(a) and 35 U.S.C. § 132(a).

What is claimed is:

1. A modular component desk system comprising:

a modular attachment frame comprising:

a plurality of magnets in an upper surface of the modular attachment frame; and a plurality of threaded holes in the modular attachment frame, the threaded holes being spaced apart from each other;

a desktop comprising a plurality of magnets in a lower surface of the desktop, ones of the magnets in the desktop being arranged to be attracted to corresponding ones of the magnets in the modular attachment frame;

a storage compartment comprising a plurality of through-holes and an attachment plate having a plurality of through-holes which correspond to the threaded holes in the modular attachment frame;

a plurality of vertical supports configured to be removably attached to the modular attachment frame, wherein the vertical supports and the storage compartment are configured to be attached to the modular attachment frame at different points.

2. The modular component desk system of claim 1, wherein the modular attachment frame has a through-hole.

3. The modular component desk system of claim 1, further comprising a multilevel attachment plate comprising a plurality of through-holes aligned with the threaded holes of the modular attachment frame.

4. The modular component desk system of claim 3, wherein the multilevel attachment plate comprises two surfaces connected by a center piece extending normal to each surface.

5. The modular component desk system of claim 4, further comprising:

a second modular attachment frame; and a second desktop, wherein the modular attachment frame is a first modular attachment frame, and wherein the first modular attachment frame and the second modular attachment frame are attached together by the plate.

6. The modular component desk system of claim 1, wherein the plurality of vertical supports are peg shaped vertical supports and comprise a flat attachment plate at the top thereof aligned with the threaded holes of the modular attachment frame at multiple points.

7. The modular component desk system of claim 1, wherein the plurality of vertical supports are T shaped vertical supports comprising a first linear portion and a second linear portion, the second linear portion being normal to the first linear portion.

8. The modular component desk system of claim 1, further comprising a cable tray having a plurality of through-holes aligned with the threaded holes of the modular attachment frame.

9. A modular desk comprising:

a frame having a plurality of spaced apart screw holes extending through the frame;

a desktop surface configured to be removably attached to the frame;

a plurality of legs configured to removably attached to the frame; and a plurality of storage compartments configured to be removably attached to the frame, wherein the legs and the storage compartments are configured to be attached to the frame in various orientations.

10. The modular desk of claim 9, wherein the plurality of storage compartments comprises a keyboard drawer, a plurality of different sized drawers, and a plurality of cabinets.

11. The modular desk of claim 9, wherein the plurality of legs are reversible in their orientation.

* * * * *